US007249832B2

(12) United States Patent
Sakai et al.

(10) Patent No.: US 7,249,832 B2
(45) Date of Patent: Jul. 31, 2007

(54) LIQUID CARTRIDGE AND METHOD FOR MANUFACTURING LIQUID CARTRIDGE

(75) Inventors: Yasuto Sakai, Fukui-ken (JP); Satoshi Shinada, Nagano-ken (JP); Taku Ishizawa, Nagano-ken (JP); Akira Ichihashi, Nagano-ken (JP); Yuichi Seki, Nagano-ken (JP); Akihiko Kitazawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 182 days.

(21) Appl. No.: 10/731,645

(22) Filed: Dec. 8, 2003

(65) Prior Publication Data

US 2004/0165045 A1 Aug. 26, 2004

(30) Foreign Application Priority Data

Dec. 10, 2002 (JP) ..... 2002-358762
Jul. 31, 2003 (JP) ..... 2003-205038

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS 6,070,976 A * 6/2000 Takagi et al. ..... 347/86
6,106,112 A * 8/2000 Okubo et al. ..... 347/86
6,281,911 B1 * 8/2001 Nakazawa et al. ..... 347/36
6,286,950 B1 * 9/2001 Altendorf et al. ..... 347/86
6,409,326 B1 * 6/2002 Giles et al. ..... 347/87
6,666,551 B2 * 12/2003 Kobayashi et al. ..... 347/86
6,758,556 B2 * 7/2004 Ishizawa et al. ..... 347/86
6,773,099 B2 * 8/2004 Inoue et al. ..... 347/86
2002/0109760 A1 8/2002 Miyazawa et al.

FOREIGN PATENT DOCUMENTS

JP 5-62448 U 8/1993
JP 5-62448 U 8/1993
JP 10-235889 A 9/1998
JP 10-235889 A 9/1998
JP 2000-000977 A 1/2000
JP 2001-212977 A 8/2001
JP 2001-277530 A 10/2001
JP 2001-341324 A 12/2001
JP 2002-120379 A 4/2002
JP 2002-207807 A 7/2002
JP 2002-337356 A 11/2002

* cited by examiner

*Primary Examiner*—Anh T. N. Vo
(74) *Attorney, Agent, or Firm*—Stroock & Stroock & Lavan LLP

(57) ABSTRACT

An ink cartridge has a cartridge body having an opening part, which is opened, at a first side face, a lid attached to the first side face for covering the opening part, engaging parts having extending parts extending along a second side face adjacent to the first side face, end parts, provided at ends of the extending parts, of which heights are higher than the extending parts in a direction perpendicular to the second side face and penetrating parts, provided at the extending parts, penetrating in a direction perpendicular to the second side face, and caulking parts protruding from the cartridge body to penetrate the penetrating parts in a direction perpendicular to the second side face, being caulked over the extending parts.

15 Claims, 17 Drawing Sheets

LIQUID CARTRIDGE AND METHOD FOR MANUFACTURING LIQUID CARTRIDGE

BACKGROUND OF THE INVENTION

This application claims priority from Japanese Patent Applications Nos. 2002-358762 filed on Dec. 10, 2002 and 2003-205038 filed on Jul. 31, 2003, the contents of which are incorporated herein by reference.

1. Field of the Invention

The present invention relates to a liquid cartridge and a method for assembling a liquid cartridge. More particularly, the present invention relates to a liquid cartridge and a method for assembling a liquid cartridge, which prevent foreign particles from being mixed with a liquid during assembling and have enough strength and assembling convenience.

2. Description of the Related Art

An inkjet type recording apparatus as an example of a liquid ejecting apparatus performs recording on materials to be recorded by ejecting ink from nozzles formed in a recording head. An ink cartridge is mounted on the inkjet type recording apparatus and supplies a liquid to the inkjet type recording apparatus. In this ink cartridge, a case and a lid, which forms a liquid containing chamber that contains ink with the case, are fixed by vibration welding as disclosed, for example, in Japanese Patent Application Publication No. 2001-212977.

However, there was a problem that dust or foreign particles generated during the vibration welding was mixed with ink in the structure or assembling method of fixing the lid by the vibration welding.

SUMMARY OF THE INVENTION

Therefore, it is an object of the present invention to provide a liquid cartridge and a method for assembling a liquid cartridge, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a liquid cartridge for supplying a liquid by being mounted on a liquid ejecting apparatus, comprises a container body having an opening part, which is opened, at a first side face, a lid, which is attached to the first side face of the container body, for covering the opening part, a penetrating part formed at the container body or the lid and a caulking part, which is formed at the container body or the lid, which does not have the penetrating part, and is inserted into the penetrating part, in order for a tip part thereof to be caulked.

Due to this configuration, it is possible to prevent the dust or the foreign particles from being mixed into the inside of the liquid cartridge, when assembling the lid with the container body of the liquid cartridge, unlike assembling by vibration welding.

And, The liquid cartridge above further comprises a sealing member having flexibility for forming a liquid containing chamber, which is a closed space for containing a liquid in association with the container body by sealing the opening part of the container body, wherein the sealing member is covered by the lid at the first side face.

Due to this configuration, it is possible to allow the sealing member to keep the liquid containing chamber sealed tightly and to prevent this sealing member from being broken. Particularly, if the sealing member is a resin film and the container body has a resin characteristic, it is possible to securely join the sealing member with the container body with thermal welding and to form a liquid containing chamber which has high liquid tightness. Particularly, if welding parts between the inside of the container body and the sealing member exist complicatedly, it is possible to join with high liquid tightness by using particularly a film.

In addition, the sealing member in the liquid cartridge above comprises a sealing member extending part, which extends to an area facing an edge part of the cartridge body and an edge part of the lid, and the sealing member extending part is fixed by being put between the edge part of the cartridge body and the edge part of the lid.

Due to this configuration, it is possible to more firmly fix the sealing member.

Moreover, in the liquid cartridge above, the penetrating part is formed at an engaging part, which has an extending part that extends along a second side face adjacent to the first side face of the container body.

Due to this configuration, it is possible to form a fixed part at a plurality of side faces in the liquid cartridge and to enhance the degree of freedom in regard to a design. Further, it is possible to arrange fixed parts by caulking at side faces difficult to stand out and to improve a design.

Moreover, in the liquid cartridge above, the engaging part has an end part, of which a height is higher than a face of the extending part in a direction perpendicular to the second side face, at an end of the extending part.

Due to this configuration, since the end part of the engaging part is engaged with the caulking part, the caulking part is securely fixed.

Moreover, the liquid cartridge above comprises a side wall part, of which a height is higher than a face of the extending part in a direction perpendicular to the second side face, along both side ends of the extending part.

Due to this configuration, since the caulking part, of which the side wall part is deformed by caulking, is blocked up, the deviation of deformation of the caulking part is suppressed. In addition, it is possible to reduce the effect caused by an external force toward the caulking part caulked. Further, since the caulking part that is deformed gets close to the side wall part, it is possible to suppress the rattling between the lid and the cartridge body in a direction of the side wall.

Moreover, the liquid cartridge above further comprises an engagement hollow part, which is provided at the container body or the lid and has substantially the same width as the engaging part, for accepting the engaging part, wherein a depth of the engagement hollow part is substantially the same as that of the end part in a direction perpendicular to the second side face.

Due to this configuration, when assembling the lid with the container body, since the engaging part does not protrude from the side face of the container body, it is possible to improve the appearance. In addition, it is possible to prevent the caulking from being got off in using the liquid cartridge because the engaging part is attached to the liquid ejecting apparatus. Further, since the width of the engagement hollow part is substantially the same as that of the engaging part, the rattling between the lid and the container body.

Moreover, in the liquid cartridge above, the container body or the lid is provided with either of the engaging part or the caulking part respectively at a plurality of the second side faces adjacent to the first side face, and the penetrating part of the engaging part at first one of the plurality of the second side faces is a penetrating hole in order for the caulking part to be inserted, while the penetrating part of the engaging part at second one of the plurality of the second side faces is formed as a notch in order for the caulking part to be inserted.

Due to this configuration, the fitting characteristic of the lid to the container body is improved, and beside when detaching the lid from the container body, it is possible to avoid the lid from being detached and to securely join the lid and the container body.

Moreover, in the liquid cartridge above, a caulking part, which extends in a direction perpendicular to the first side face, is formed at the container body or the lid, while a penetrating part, into which the caulking part is inserted, is formed at the container body or the lid, which does not have the caulking part.

Due to this configuration, it is possible to make the fitting characteristic and the manufacture of the lid to the container body easy.

Moreover, in the liquid cartridge above, a liquid supplying part is formed at a side face adjacent to the first side face of the container body and communicates with a liquid containing chamber formed at the container body, and he container body or the lid is provided with a plurality of engaging parts, which extend along a second side face adjacent to the first side face in order to hold the liquid supplying part, while the container body or the lid, which does not have the engaging parts, is provided with a plurality of caulking parts, one of which is inserted into the penetrating part provided at the engaging part.

Due to this configuration, it is possible to more securely fix the lid with the container body in the circumference of the liquid supplying part.

Moreover, in the liquid cartridge above, the penetrating part of the engaging part is formed as a penetrating hole at the side face at which the liquid supplying part is formed.

Due to this configuration, it is possible to more securely fix the lid with the container body in the circumference of the liquid supplying part.

Moreover, in the liquid cartridge above, the container body or the lid comprises an engaging part, which extends along a side face adjacent to the side face, at which the liquid supplying part is formed, and adjacent to the first side face, and a penetrating part of the engaging part is formed as a notch, of which an end part is opened.

Due to this configuration, it is possible to fit the caulking part into the penetrating part, which is formed as the notch, by fitting the engaging part near the liquid supplying part with the caulking part and turning.

Moreover, in the liquid cartridge above, the container body or the lid is provided with a caulking part, which extends in a direction perpendicular to the first side face, near a side face opposite to the side face at which the liquid supplying part is formed, while the container body or the lid, which does not have the caulking part, is provided with a penetrating part, which penetrates in a direction perpendicular to the first side face, into which the caulking part is inserted.

Due to this configuration, it is possible to fit the penetrating part with the caulking part easily by fitting the engaging part near the liquid supplying part with the caulking part and turning. And, since the caulking part does not protrude in a direction different from the fixed direction of the liquid supplying opening, a part, in which the caulking part is not deformed, is related against a force in a direction perpendicular to and parallel to the first side face, so that it is possible to accomplish a firm fixation.

Moreover, the liquid cartridge above further comprises a groove part, which is provided at two side faces of the container body or the lid, wherein the two side faces are parallel to each other among second side faces adjacent to the first side face, and extend to be parallel to the first side face, and a rail part, which is provided at the container body or the lid, which does not have the groove part and is guided by the groove part, wherein a penetrating part and a caulking part are provided at a side face perpendicular to the two side faces, which are parallel with each other, among the second side faces.

Due to this configuration, the position of the lid to the container body is easily determined. And, since the side face, at which the rail part and the groove part are provided, is fixed by the fitting the rail part and the groove part, it is possible to reduce the places at which the caulking is provided, and to easily attach the lid to the container body.

Moreover, the liquid cartridge above is provided with a memory supporting part for supporting a memory for storing information about a liquid at a second side face adjacent to the first side face of the container body, wherein the memory supporting part is attached to the container body to cover at least one of the caulking parts.

Due to this configuration, it is possible to prevent the caulking part from being got out of the engaging part after the liquid cartridge is manufactured.

Moreover, in the liquid cartridge above, the memory supporting part is attached to the container body by caulking a portion of the memory supporting part at a portion of the container body.

Due to this configuration, it is possible to easily fix the memory supporting means to the container body without using an adhesive etc.

According to the second aspect of the present invention, a method for manufacturing a liquid cartridge, which comprises a container body having an opening part, which is opened, at a first side face, a lid, which is attached to the first side face of the container body, for covering the opening part, a penetrating part formed at the container body or the lid and a caulking part, which is formed at the container body or the lid, which does not have the penetrating part, and is inserted into the penetrating part, in order for a tip part thereof to be caulked, wherein the method comprises determining a position of the lid in regard to the first side face of the container body by fitting the caulking part into the penetrating part and performing caulking by deforming the tip part of the caulking part with heat.

According to this method, it is possible to prevent the dust or the foreign particles from being mixed into the inside of the liquid cartridge, when assembling the lid with the container body of the liquid cartridge, unlike assembling by vibration welding.

In the method for manufacturing a liquid cartridge, the container body or the lid is provided with either of the engaging part, which has an extending part that extends along a second side face adjacent to the first side face and the penetrating part, or the caulking part respectively at a plurality of the second side faces, and the penetrating part of the engaging part at first one of the plurality of the second side faces is a penetrating hole in order for the caulking part to be inserted, while the penetrating part of the engaging part at second one of the plurality of the second side faces is formed as a notch in order for the caulking part to be inserted, and the position determining step comprises fitting the engaging part, which has the penetrating hole at the first one of the plurality of the second side faces, with the caulking part corresponding to the penetrating hole and fitting the caulking part, which corresponds to a notch at the second one of the plurality of the second side faces, into the engaging part having the notch by turning the lid toward the container body, taking a fitted part between the penetrating hole and the caulking part as a turning center.

According to this method, it is possible to fit the penetrating part having a notch with the caulking part easily without falling off, by fitting the caulking part into the penetrating part having a penetrating hole and turning.

In the method for manufacturing a liquid cartridge, the container body or the lid is provided with a caulking part, which extends in a direction perpendicular to the first side face, near a side face opposite to the second side face at which the engaging part having the penetrating hole is formed, while the container body or the lid, which does not have the caulking part, is provided with a penetrating hole, which penetrates in a direction perpendicular to the first side face into which the caulking part is inserted, and the position determining step further comprises fitting the penetrating part, which penetrates in a direction perpendicular to the first side face, with the caulking part, which extends in a direction perpendicular to the first side face, by turning the lid toward the container body, taking a fitted part between the penetrating hole and the caulking part as a turning center.

According to this method, it is possible to fit the penetrating part having a notch, which is formed in a direction perpendicular to the first side face, with the caulking part easily without falling off, by fitting the caulking part into the penetrating part having a penetrating hole at the side face adjacent to the first side face and turning.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
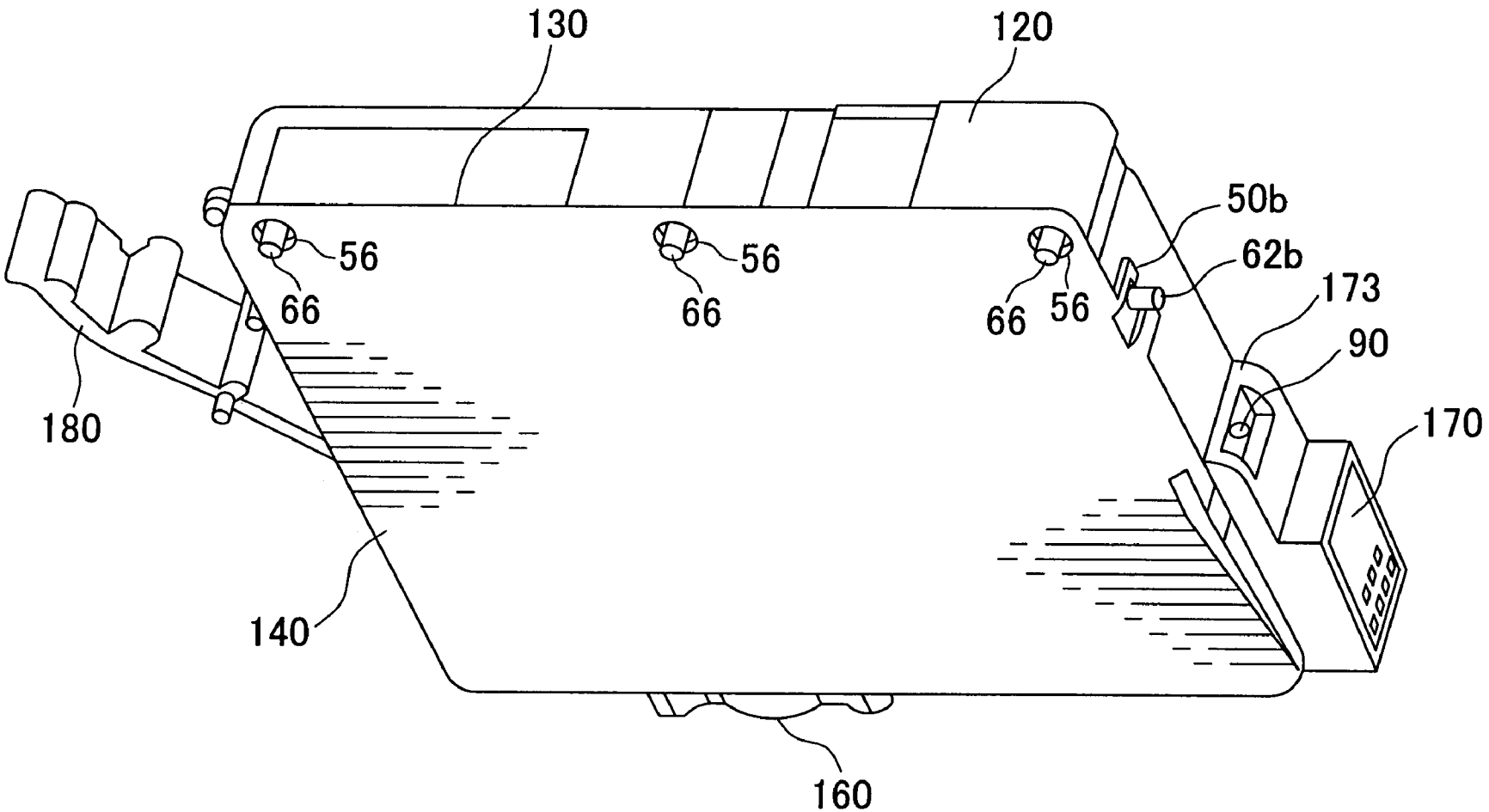
FIG. 1 is a front perspective view of an ink cartridge 100 according to a first embodiment.

FIG. 1 is a front perspective view of the structure of the ink cartridge 100 used for an inkjet type recording apparatus, which is adapted for an example of a liquid cartridge suitable for supplying a liquid to a liquid ejecting head of a liquid ejecting apparatus, obliquely viewed from an upper position.

In addition, the liquid ejecting apparatus of the present invention is not limited to the liquid ejecting head of the liquid ejecting apparatus, and it includes a color material ejecting head of the color filter manufacturing apparatus for manufacturing color filters of a liquid crystal display, an electrode material (conduction paste) ejecting head for forming electrodes such as an organic EL display or a FED (Field Emission Display) and further a bio organism ejecting head of the bio-chip manufacturing apparatus and a sample ejecting head as a minute pipette for manufacturing bio-chips.

Figure 2:
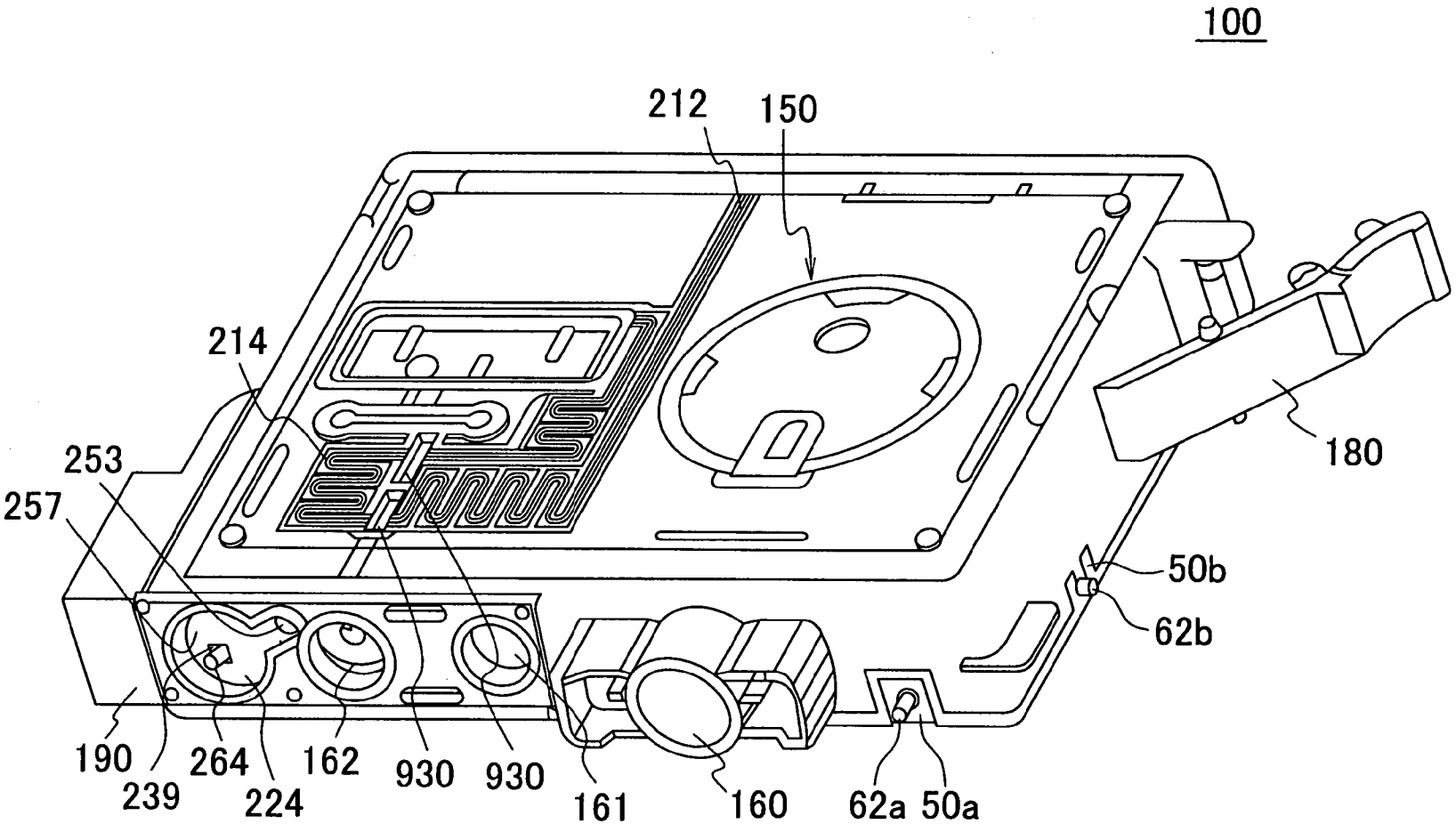
FIG. 2 is a rear perspective view of an ink cartridge 100 before a film 110 is attached.
Figure 3:
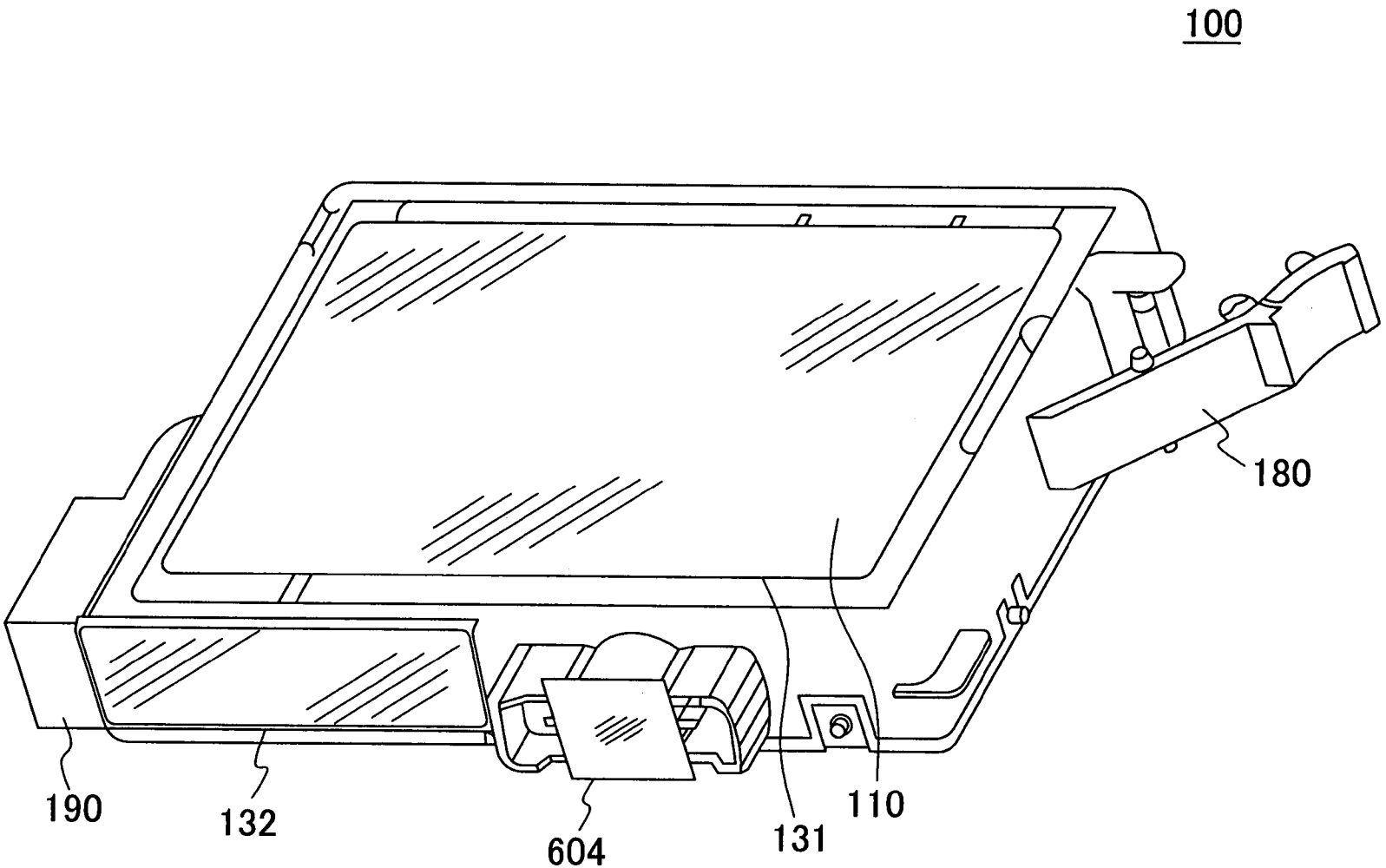
FIG. 3 is a rear perspective view of an ink cartridge 100 before a film 110 is attached.
Figure 4:
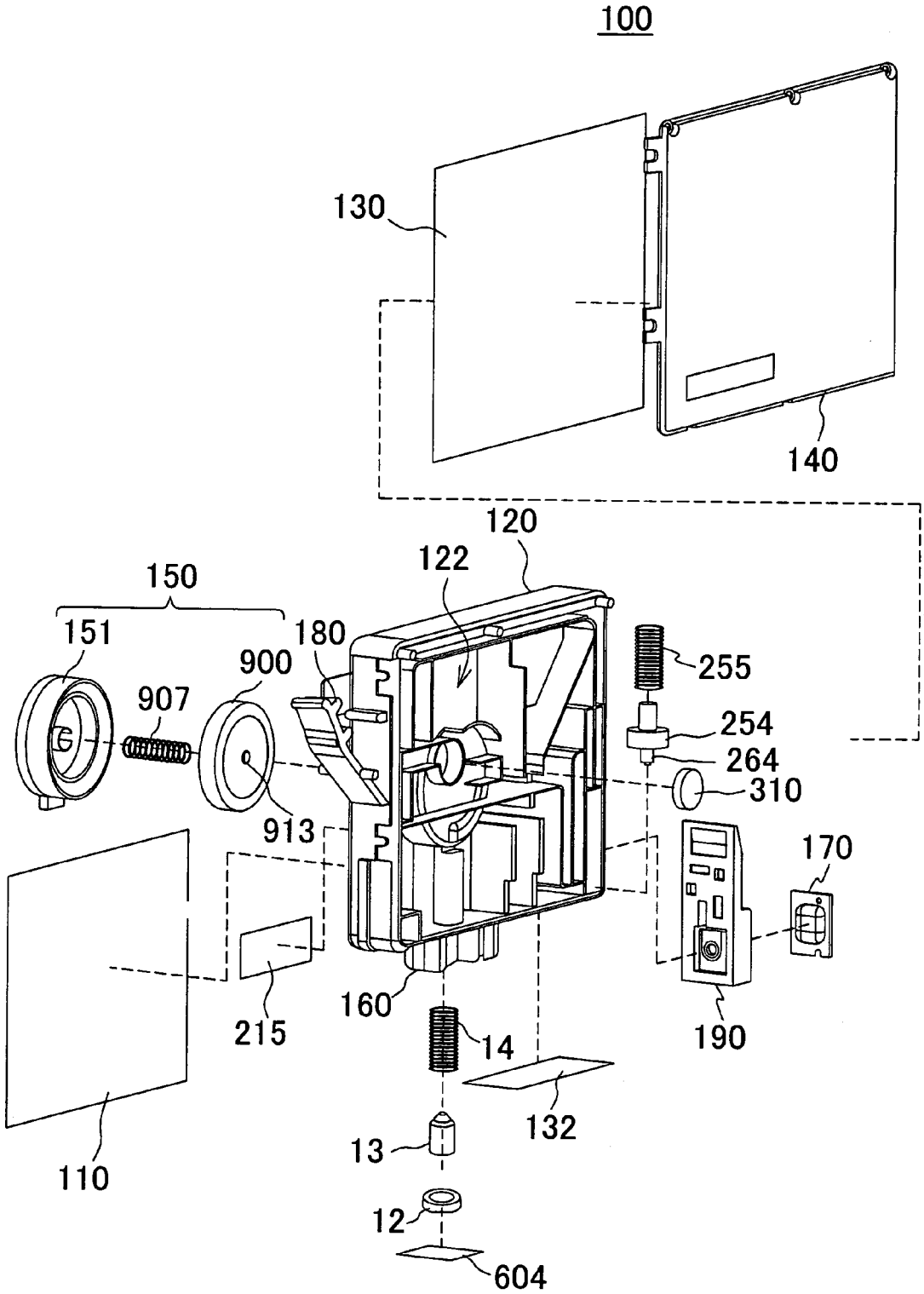
FIG. 4 is an exploded perspective view of an ink cartridge 100.
Figure 5:
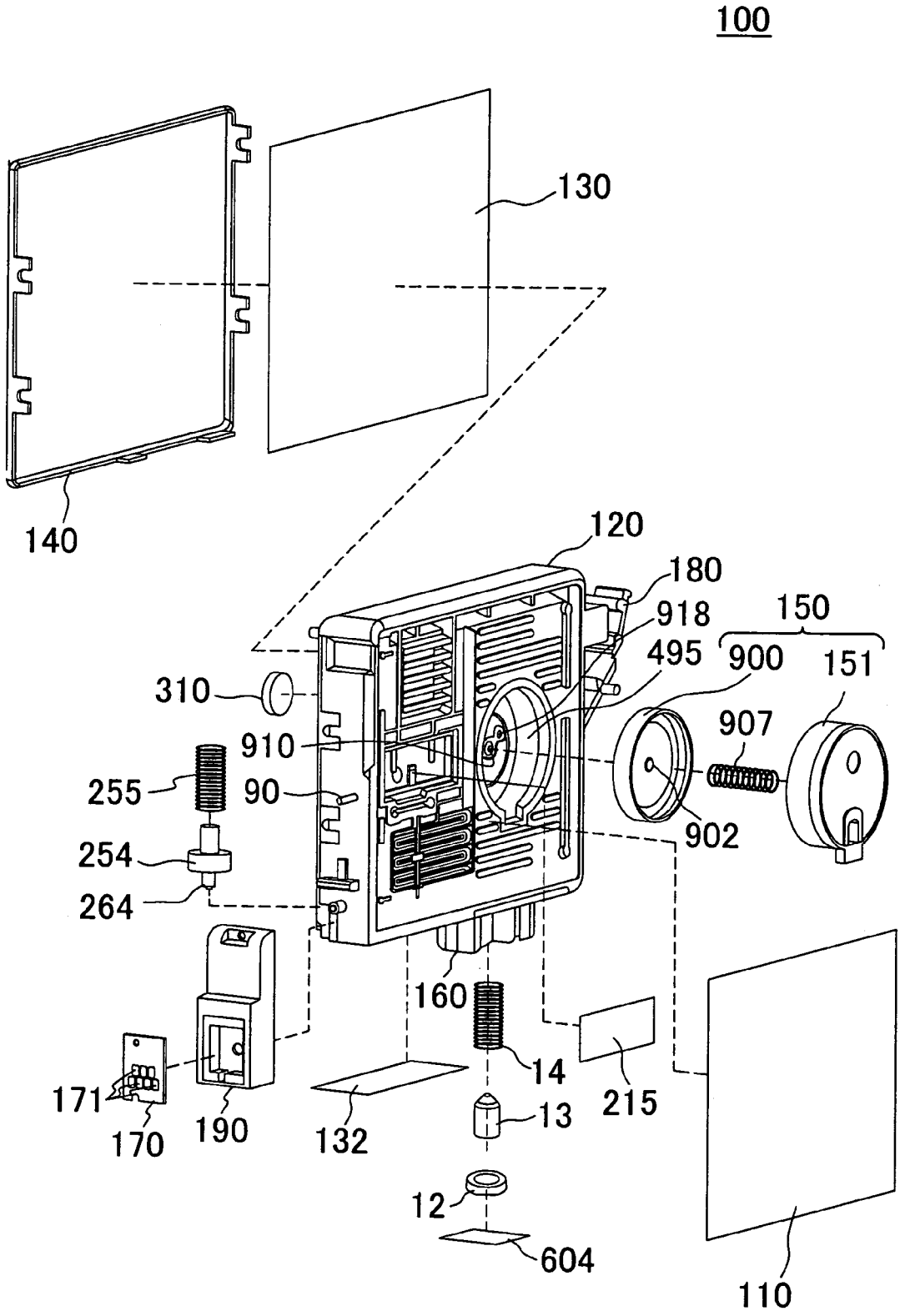
FIG. 5 is an exploded perspective view of an ink cartridge 100.
Figure 6:
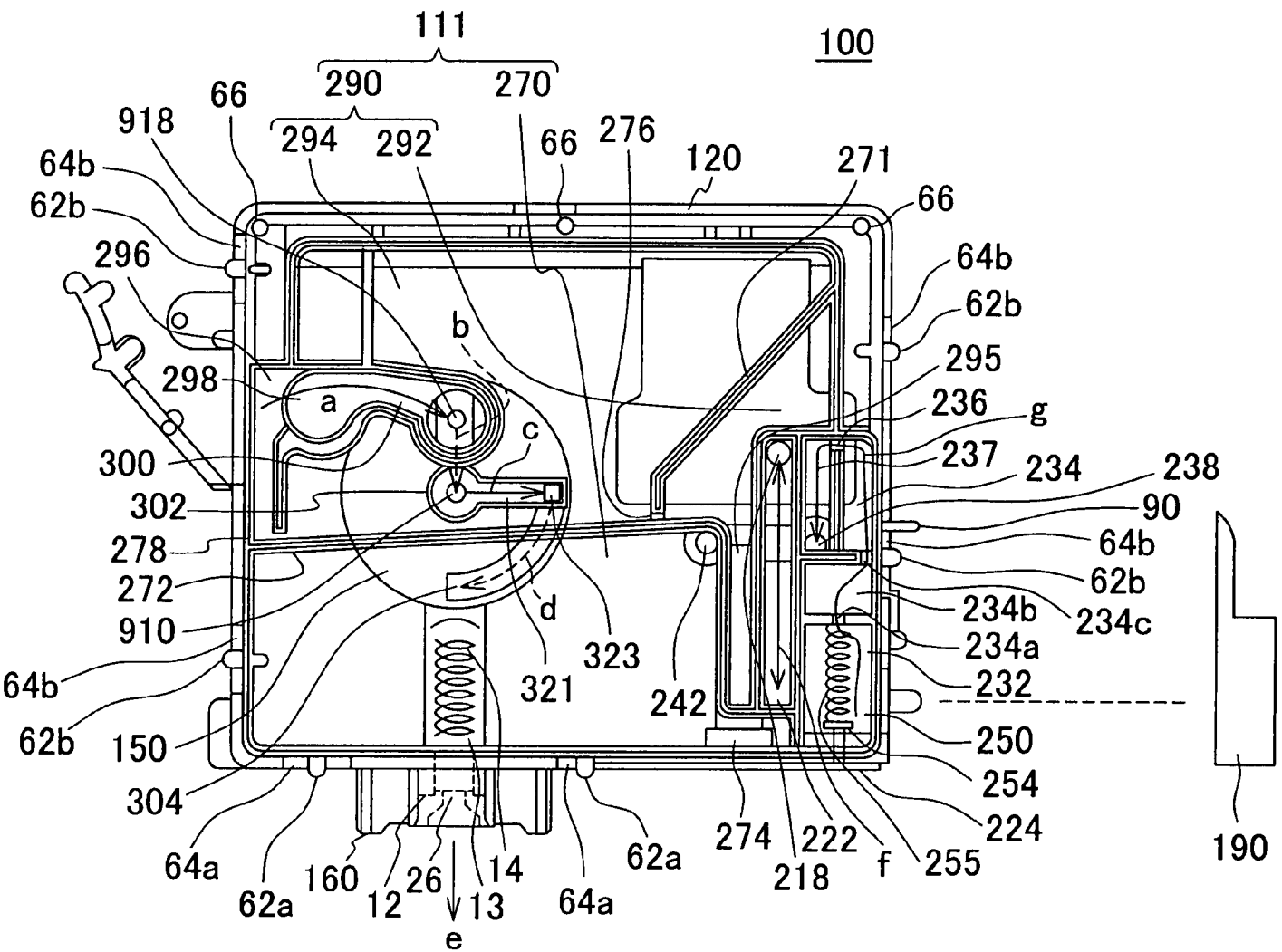
FIG. 6 is a front view of an ink cartridge 100 in a state before a film 130 is attached.
Figure 7:
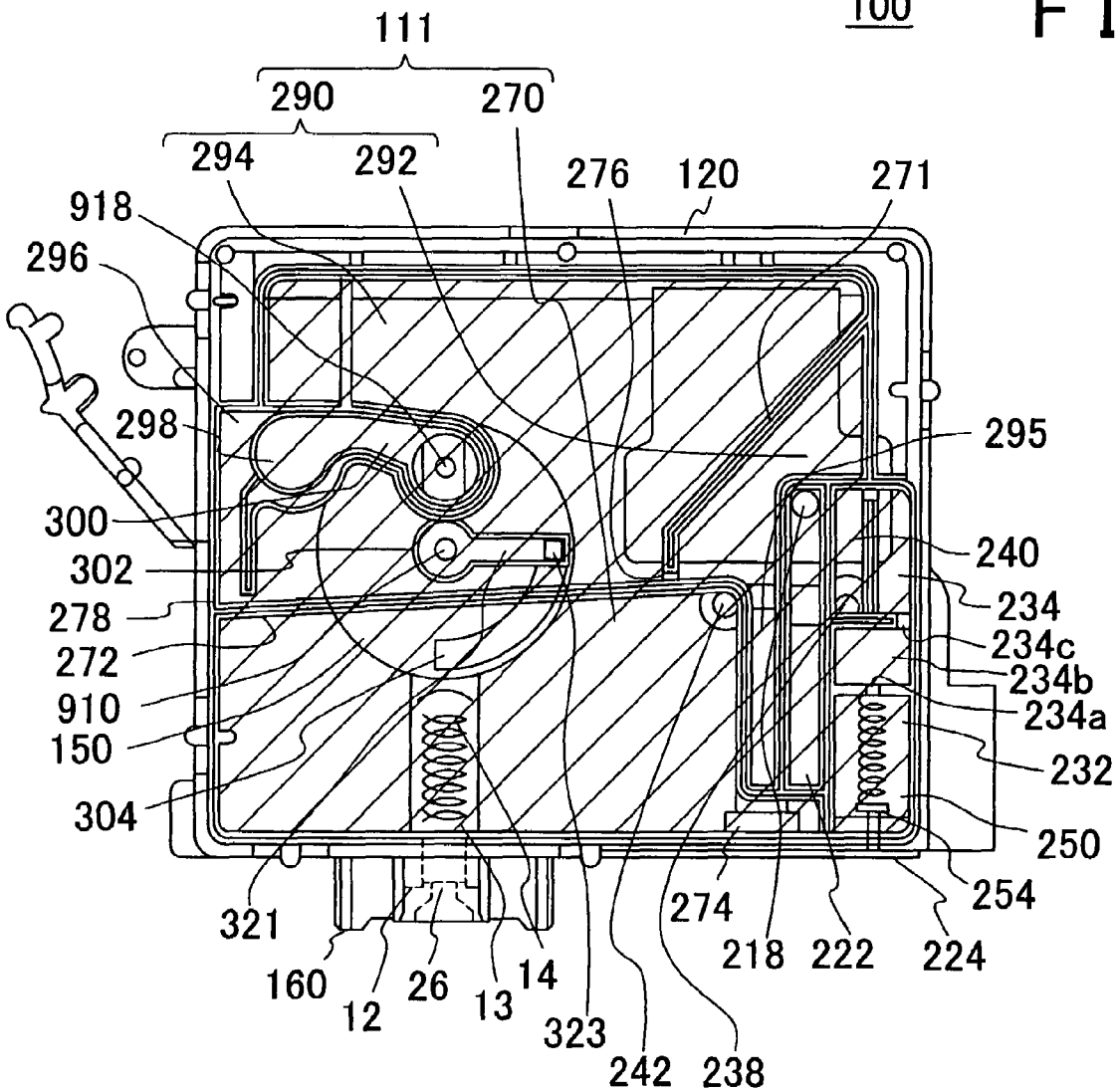
FIG. 7 is a front view of an ink cartridge 100 in a state after a film 130 is attached.

FIG. 2 and FIG. 3 are rear perspective views the ink cartridge 100 in FIG. 1 obliquely viewed from a lower position, FIG. 2 shows the ink cartridge 100 in a state a film 110 is not attached thereto and FIG. 3 shows the ink cartridge 100 in a state the film 110 is attached thereto. Further, FIG. 4 and FIG. 5 are perspective views showing the ink cartridge 100 wherein members of which the ink cartridge 100 consist is exploded. FIG. 6 and FIG. 7 are front views of the ink cartridge 100 in FIG. 1, FIG. 6 shows the ink cartridge 100 in a state before a film 130 is attached to an opening part 122 of the ink cartridge 100 and FIG. 7 shows the ink cartridge 100 in a state in which a film 130 is attached to an opening part 122 of the ink cartridge 100. In addition, the film 130 made of resin is attached to an area, which is shown with hatching in FIG. 7. The film 130 is an example of a sealing member relating to the present invention.

As shown in FIG. 4, the ink cartridge 100 has a cartridge body (the container body) 120 having a shape of an approximate case with the opening part 122, the film 130, which covers almost all face of the opening part 122 and a lid 140, which covers the outside of the film 130. The internal part of the cartridge body 120 is partitioned by ribs or walls as described below. The film 130 seals almost all face of the opening part 122 of the cartridge body 120 in order that the internal part of it comes into a closed state. The film 130 is fixed to the cartridge body 120 by for example thermal compression bonding in the way of avoiding the dust or the foreign particles from occurring in the ink cartridge 100. The lid 140 is further fixed to the cartridge body 120 in order to wrap the outside of the film 130 in a non-closed state.

The cartridge body 120 has an ink accommodating section 111 for containing ink, an ink channel part from the ink accommodating section 111 to an ink supplying part 160, an ink side passage, which allows the ink accommodating section 111 to communicate with the atmosphere, the atmospheric valve containing part and an atmosphere communicating part, which consists of an atmosphere passage, and it is made of, for example, Polypropylene (PP) in a unified body.

The ink cartridge 100 further has an ink supply controlling means 150, a memory 170 and an engaging lever 180. The ink supplying part 160 supplies ink, which is contained in the ink accommodating section 111, to the recording head of the inkjet type recording apparatus through an ink supply needle of the apparatus which needle is inserted into an opening of said ink supplying part 160. The ink supply needle faces the lower face of the cartridge body 120 and is formed on the carriage mounting there on the ink cartridge 100. The memory 170 is caulked into a memory supporting part 190 and the memory supporting part is caulked and attached to the lower part of the side face of the cartridge body 120. The memory 170 stores the information on the kind of the ink cartridge 100, the information on the color held by the ink cartridge 100 and the information on the present amount of remaining ink etc., and it transfers this information by a plurality of terminals 171, which are exposed thereon, between the apparatus body and the ink cartridge 100. The engaging lever 180 is formed at the upper part of the side face opposite to the memory supporting part 190 in regard to the cartridge body 120, and is engaged with the carriage of the inkjet type recording apparatus.

An ink supply controlling means 150 consists of a differential pressure valve, which supplies ink of the ink accommodating section 111 to the ink supplying part 160 by pressure difference between ink accommodating section 111 and the ink supplying part 160 that occurs accompanying the consummation of ink. The ink supply controlling means has a membrane valve 900, which is an example of a valve member inserted into a hollow part 495 of the cartridge body 120, capable of elastic deformation, a valve lid 151 which covers the hollow part 495, a coil spring 907 which is an example of an urging member arranged between the membrane valve 900 and the valve lid 151.

The ink accommodating section 111 is divided by a wall 272 mainly into a upper part and a lower part, which extends in a horizontal direction, as shown in FIG. 6 and FIG. 7, and an atmosphere side containing part 270, which can communicate with the atmosphere by a communicating hole 242, is formed in the lower part, while a supply side containing part, which consists of a first ink accommodating section 292 and a second ink accommodating section 294 and is blocked from the atmosphere, is formed in the upper part. The supply side containing part 290 is divided by a slope wall 271 having a communicating part 276 near the wall 272 (at the lower part area) into the first and second ink accommodating sections 292 and 294, and is provided with a channel part 296, which is arranged in order to surround the circumference of the second ink accommodating section 294. The channel part 296 is coupled with the second ink accommodating section 294 via a communicating part 278 at the lower part, and besides is coupled with the ink supply controlling means 150 via passages 298 and 300 and a passage hole 918.

Moreover, the lower flow side of the ink supply controlling means 150 is configured to communicate with the ink supplying part 160 via a passage hole 910 which communicates with the ink supply controlling means 150, a communicating part 302 and a channel 321 which communicate with the passage hole 910, a passage hole 323 which is formed at an end of the channel 321 and is formed to face the front face side and a communicating part 304 of which an end communicates with the passage hole 323.

The atmosphere side containing part 270 and the first ink accommodating section 292 communicate with each other by a communicating passage 295 which extends vertically, and are configured in order that the ink in the atmosphere side containing part 270 is sucked up into the first ink accommodating section 292 corresponding to the consummation of ink from the ink supplying part 160 and then flows into the ink supply controlling means 150 via the second ink accommodating section 294 and the channel part 296 etc. The ink flows into the ink supply controlling means 150 from the atmosphere side containing part 270 of the ink accommodating section 111 through a sequence of the communicating part 274, a second ink inlet 162, a communicating passage 295, the communicating parts 276 and 278, the channel part 296, the passages 298 and 300 and the passage hole 918.

Meanwhile, the atmospheric valve part 250 has a hollow part 232 serving as a valve accommodating section or chamber which is an atmospheric valve containing part for containing an atmospheric valve 254, and has a communicating hole 239, also serving as a atmosphere communicating channel, of which the diameter is a little larger than that of a shaft part 264 of the atmospheric valve 254, on the wall face of a lower position of the valve accommodating section 232, so that the shaft part 264 of the atmospheric valve 254 is always urged towards the bottom face of the ink cartridge 100 by a spring 255 and inserted thereto to be able to freely slide, and the communicating hole 239 is sealed by the atmospheric valve 254 when the ink cartridge 100 is not mounted onto the carriage of the inkjet type recording apparatus.

Figure 8:
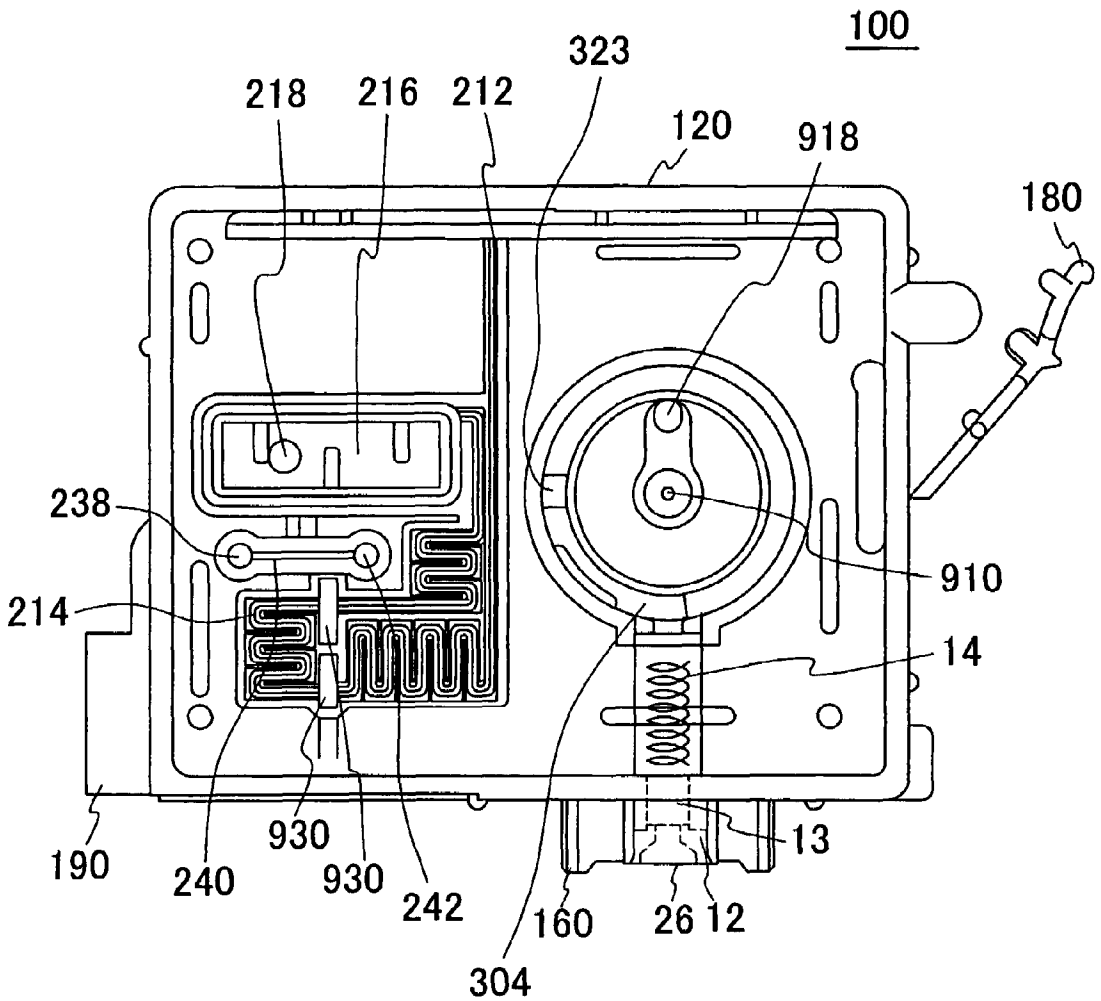
FIG. 8 is a rear view of an ink cartridge 100 in a state before a film 110 is attached.

FIG. 8 is a rear view showing the ink cartridge 100 of FIG. 1 in a state before the film 110 is attached thereto. The atmosphere side passage, which communicates with the atmosphere taking the communicating hole 239 described above as a boundary, consists of an opening 212, a passage 214 which is circuitous or winding, a filter containing part 216, a communicating hole 218, a communicating part 222 and a communicating hole 253 and a communicating part 224 which are formed on the bottom face of the communicating part 222.

Particularly, as shown in FIG. 8, an end of one passage 214, which is formed on the front face of the cartridge body 120 and winding in the shape of a maze, is opened with the atmosphere by the opening 212, and the other end is coupled with the filter containing part 216 for containing the filter 215 (FIG. 4 and FIG. 5) having a function of ink repellency and air permeability. The filter container part 216 communicates with the communicating hole 218, which penetrates from the front side to the rear side of the cartridge body 120. The communicating hole 218 is coupled with the communicating part 224 via the communicating part 222 and the communicating hole 253, which is formed on the bottom part of a room that partitions the communicating part 222, in the rear side of the cartridge body 120. In the middle of the passage 214, a chamber 930, which consists of a concave part, is provided.

As shown in FIG. 2, the communicating part 224 is formed as a concave part 257 on the bottom face of the cartridge body 120, and a shaft part 264, which is an operating rod of the atmospheric valve 254, is exposed, while the communicating hole 239 capable of communicating with the valve accommodating section 232, which contains the atmospheric valve 254, and the communicating hole 253, which communicates with the communicating part 222, are formed inside the concave part 257, and the external face of the concave part 257 is sealed by the film 132 for sealing the first and second ink inlets 161 and 162. A thing, which can perform elastic deformation by a pressing force of a projection protruding from the carriage, is chosen for this film 132.

Meanwhile, as shown in FIG. 6, the ink side passage, which communicates with the atmosphere side containing part 270 taking the communicating hole 239 described above as a boundary, consists of an valve accommodating section 232, a passage hole 234*a*, a communicating chamber 234*b*, a communicating part 234*c*, a communicating chamber 234*d*, a communicating part 236, a communicating chamber 237 and a communicating hole 238, a communicating groove 240 and a communicating hole 242. Particularly, the passage hole 234*a* is formed on a wall of upper part of the valve accommodating section 232, and the atmosphere passage is formed to communicate in the following sequence: the communicating chamber 234*b* via the passage hole 234*a*, the communicating part 234*c* formed by a notch on a wall of the upper part of the communicating chamber 234*b*, the communicating chamber 234*d* provided at the upper part of the communicating part 234*c*, the communicating part 236 formed by a notch of a wall of the upper part of the communicating chamber 234*d* and the communicating chamber 237 provided with the communicating hole 238 at a lower position.

The communicating hole 238, which penetrates from the rear side to front side of the cartridge body 120, communicates with the atmosphere side containing part 270 via the communicating groove 240, which communicates with the communicating hole 238, and the communicating hole 242, which communicates with the communicating groove 240 and also penetrates from the front side to the rear side of the cartridge body 120.

These the atmosphere side containing part 270, the supply side containing part 290, the atmospheric valve part 250 and the atmosphere side passage and the ink side passage become an area which is separated from the atmosphere by attaching the films 130 and 110 to the wall partitioning each of those by thermo welding.

The ink supplying part 160 has a seal member 12, which is made of elastomer having an insertion opening 26 into which the ink supply needle provided in the carriage is inserted, a supply valve 13, which closes the insertion opening 26 of the seal member 12 and an urging member, which consists of a coil spring etc. that urges the supply valve 13 towards the seal member 12. In addition, a film 604 is attached to the insertion opening 26 of the seal member 12 at the time of factory.

When the ink cartridge 100 is mounted on the carriage of the inkjet type recording apparatus, the projecting part provided in the carriage pushes up the shaft part 264 of the atmospheric valve upwardly via the film 132 and the ink supply needle of the carriage pushes up the supply valve 13 of the ink supplying part 160 upwardly. Due to this, the communicating hole 239 allows the atmosphere channel, extending from the valve accommodating section 232 to the communicating hole 242, to communicate with the atmosphere. And, the upper flow than the supply valve 13 in regard to the ink supplying part 160 communicates with the ink supply needle.

When the inkjet type recording apparatus begins to record in a state where the communicating hole 242 communicates with the atmosphere, the recording head is supplied with ink through the ink supply needle from the ink supplying part 160. When ink is supplied from the ink supplying part 160, the ink, which flows in a sequence of an arrow a shown in FIG. 6 and the passage hole 918 in the ink accommodating section 111, flows in a sequence of arrows b, c and d shown in FIG. 6 via the ink supply controlling means 150, flows into the ink supplying part 160 and is supplied to the ink supply needle inserted in the ink supplying part 160.

According to this flow of ink, in the ink accommodating section 111, the ink of the atmosphere side containing part 270 is supplied to the supply side containing part 290. The atmosphere accompanying the consummation of ink in the atmosphere side containing part 270 flows into the atmosphere side containing part 270 from the communicating hole 242 through a route in a sequence of an arrow f in FIG. 6, the communicating part 224 of the bottom face and an arrow g. Although the liquid level of the atmosphere side containing part 270 goes down because ink is provided to the recording head from the ink supplying part 160, the channel, which is coupled with the atmosphere side containing part 270 and the supply side containing part 290, is provided with a communicating opening at the lowest part of the atmosphere side containing part 270, so that the atmosphere is not flowed into the supply side containing part 290 until all of the ink in the atmosphere side containing part 270 is moved to the supply side containing part.

After the ink in the atmosphere side containing part 270 is completely consumed, the ink in the first and second ink accommodating sections 292 and 294 of the supply side containing part 290 is consumed in that sequence. During that time, due to the surface tension caused by the meniscus of ink formed in the second ink inlet 162, which communicates with the supply side containing part 290 and the atmosphere side containing part 270, the ink in the supply side containing part 290 is prevented from flowing backward to the atmosphere side containing part 270.

When the ink in the first ink accommodating section 292 begins to be consumed, the air flows into the first ink accommodating section 292. Due to this, the liquid level of the first ink accommodating section 292 goes down, but the first and second ink accommodating sections 292 and 294 communicate by the communicating part 276 only at the lower part, so that the ink in the first ink accommodating section 292 is first consumed. When the liquid level reaches the communicating part 276 because the ink in the first ink accommodating section 292 is consumed, the air flows into the second ink accommodating section 294 according to the consummation of ink in the second ink accommodating section 294. While the ink in the second ink accommodating section is consumed, the surface tension caused by the meniscus of ink in the communicating part 276 occurs, and therefore the ink in the second ink accommodating section 294 is prevented from flowing backward to the first ink accommodating section 292.

As described above, although the ink in the atmosphere side containing part 270 and the first and second ink accommodating sections 292 and 294 is consumed in that sequence, the ink is supplied into the ink supplying part 160 through the passage hole 918 via the passage 300 from the communicating part 278, which is provided near the wall 272 that partitions the ink accommodating section into nearly two parts up and down, even though the liquid level of ink exists in any containing part.

As shown in FIG. 1 and FIG. 2, the lid 140 is provided with engaging parts 50*a* and 50*b*, which extend from the lid 140 along second side faces adjacent to a first side face having an opening part (opening part 122) of the cartridge body 120, for example, a right side face, a left side face and along a lower face. More particularly, a couple of engaging parts 50*a* are formed along the lower face, on which the ink supplying part 160 is formed, in order to hold the ink supplying part 160. The ink cartridge 100 further has caulking parts 62*a* and 62*b*, which are inserted into the penetrating parts formed in the engaging parts 50*a* and 50*b* from the cartridge body 120 and are caulked over the engaging parts 50*a* and 50*b*. When the lid 140 is attached to the cartridge body 120, tips of the caulking parts 62*a* and 62*b* are caulked in the engaging parts 50*a* and 50*b*. Since the tips of the caulking parts 62*a* of the lid 140 are caulked respectively in a couple of the engaging parts 50*a* provided on the lower face holding the ink supplying part 160, it is possible to more securely fix the cartridge body 120 and the lid 140 in regard to the ink supplying part 160. In FIG. 1 and FIG. 2, the caulking parts 62*a* and 62*b* are shown in a state before caulking for the purpose of description, they cover the surfaces of the engaging parts 50*a* and 50*b* after caulking.

In a front face side of FIG. 1, the lid 140 is provided with caulking holes 56, which are the penetrating holes penetrating the front face of the lid, while the cartridge body 120 is provided with projections 66, which penetrate and are inserted into the caulking holes 56 of the lid 140. The projections 66 are caulked over the caulking holes 56, so that the upper part of the lid 140 in FIG. 1 is fixed to the cartridge body 120.

As shown in FIG. 6, the left and right side faces and the lower face of the cartridge body 120 are provided with the caulking parts 62*a* and 62*b* at two positions each in order to correspond to the engaging parts 50*a* and 50*b* of the lid 140. The memory supporting part 190 is attached to the cartridge body 120 to cover one of the caulking parts 62*b* (right-lower one of the caulking parts 62*b* in FIG. 6) caulked corresponding to the engaging part 50*b*. The memory supporting part 190 is attached the cartridge body 120 by being caulked by a plurality of projections 90, which projects from the cartridge body 120. Due to this, the caulking parts 62*b*, which are caulked over the engaging parts 50*b*, can be concealed from the outside, and therefore it is possible to prevent the caulking parts 62 from getting out of the engaging parts 50*b*.

Figure 9:
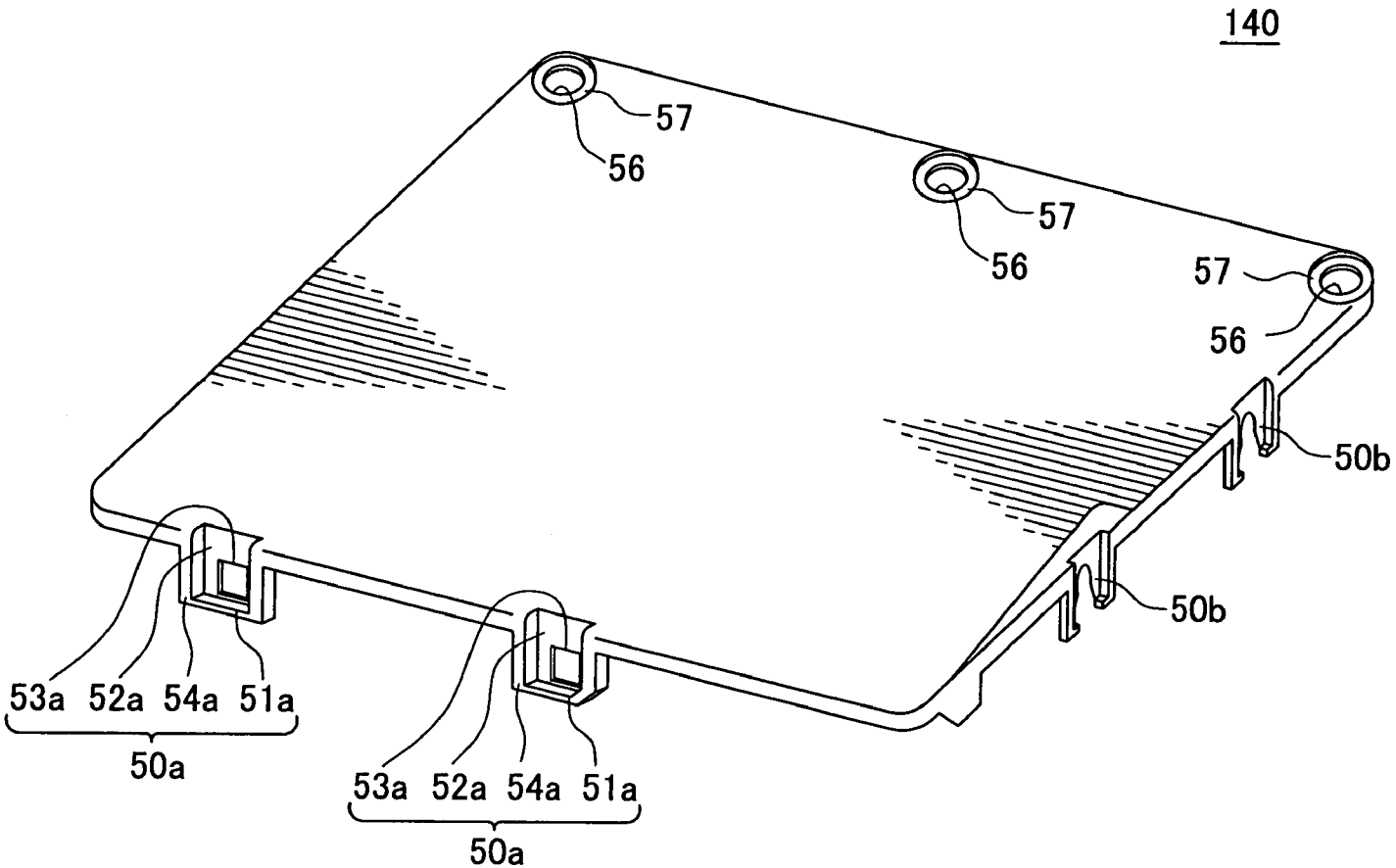
FIG. 9 is a front perspective view of a lid 140 obliquely viewed from a lower position.

FIG. 9 is a front perspective view of the front face of the lid 140 obliquely viewed from a lower position. In FIG. 9, an upper face, a lower face and left and right side faces of the lid 140 correspond to the upper face, the lower face and the left and right side faces of the ink cartridge 100 respectively. The lid 140 has the engaging parts 50*a*, which are engaged with the caulking parts 62*a* in FIG. 6, at the lower face thereof. Each of the engaging parts 50*a* has an extending part 52*a*, which extend along the lower face from the lid 140, an end part 51*a* integrally formed at an end of the extending parts 52*a*, of which the height with respect to a direction perpendicular to the lower face is higher than a plane of the extending part 52*a*. The engaging part 50*a* further includes a penetrating part 53*a*, provided at the extending part 52*a*, which is formed with a penetrating hole opening in a direction perpendicular to the lower face. The sizes of the holes of the penetrating parts 53*a* are larger than the cross-sectional areas of the caulking parts 62*a* in FIG. 6. The engaging part 50*a* further includes a side wall part 54*a*, of which the height with respect to a direction perpendicular to the lower face is the same as that of the end part 51*a* along the both side ends of the extending part 52*a*. The lid 140 further has the caulking holes 56, which are the penetrating parts into which the projections 66 in FIG. 1 are inserted, in the vicinity of a position opposite to the vicinity of a position at which the engaging parts 50*a* are provided, namely, near the upper face, and has caulking hollow parts 57 around them. By this configuration, when caulking is performed by deforming the tips of the caulking parts 62*a* or the projections 66, the concave parts surrounded by the end parts 51*a* and the side wall parts 54*a* or the caulking hollow parts 57 can accommodate the parts that are deformed, the parts, which are caulked, can be protected from the outside and the satisfactory appearance can be achieved.

Figure 10:
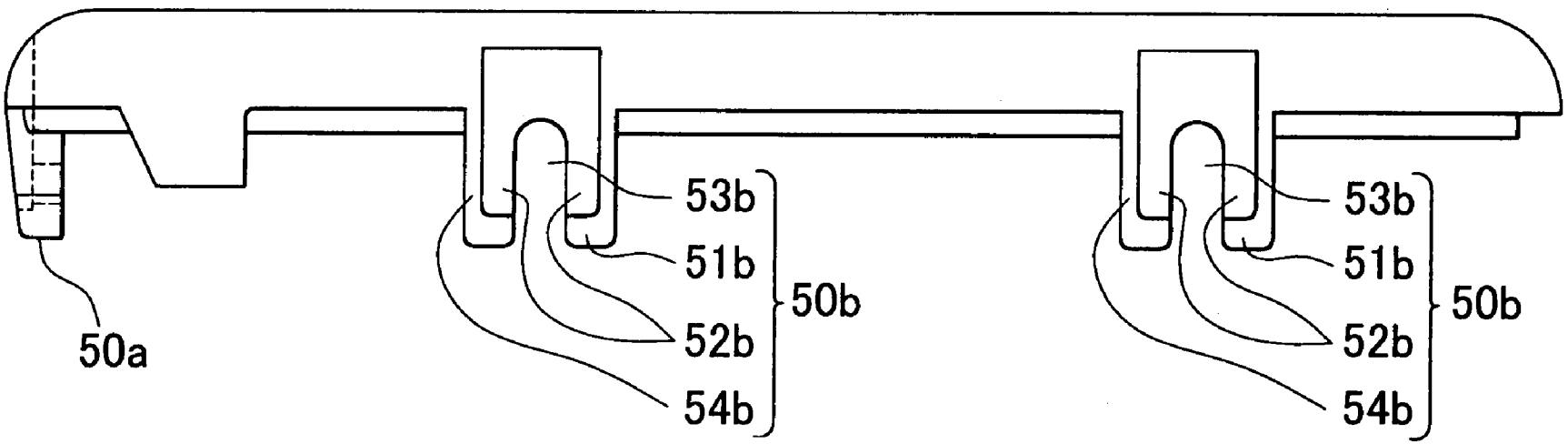
FIG. 10 is a left side view of a lid 140.

FIG. 10 is a right side view of the lid 140 in FIG. 9. The lid 140 has the engaging parts 50*b*, which are engaged with the caulking parts 62*b* in FIG. 6, on its side face. The engaging parts 50*b* of the side face, like the engaging parts 50*a* on the lower face, have extending parts 52*b*, which extend along the lower face from the lid 140, end parts 51*b* provided at ends of the extending parts 52*b* in a unified body, of which the heights in a direction perpendicular to the lower face are higher than the extending parts 52*b* and penetrating parts 53*b*, which are cut in from the end parts 51*b*. The widths of the penetrating parts 53*b* cut in are broader than those of the caulking parts 62*b* before caulking. The engaging part 50*b* further have side wall parts 54*b*, of which the heights in a direction perpendicular to the lower face are the same as the end part 51*b* along the both side ends of the extending parts 52*b*. In addition, the left side face of the lid 140 will not described because it has the same configuration as that of the right side face described above.

According to the configuration of the engaging parts 50*a* and 50*b* described above in FIG. 9 and FIG. 10, the lid 140 and the cartridge body 120 are assembled as below. The caulking parts 62*a* of the cartridge body 120 is first fitted into the penetrating parts 53*a* of the lid 140 at the lower face, and then the lid 140 is turned towards the cartridge body 120 around a part at which the penetrating parts 53*a* and the caulking parts 62*a* is fitted each other. Due to this, the caulking parts 62*b* provided at the cartridge body 120 are fitted into the penetrating parts 53*b* of the engaging parts 50*b* provided at the left and right side faces of the lid 140.

Therefore, according to the configuration of the engaging parts 50*a* and 50*b* described above in FIG. 9 and FIG. 10, the positions of the penetrating parts 53*b* and the caulking parts 62*b* at the left and right side faces can be determined by taking a part, at which the penetrating parts 53*a* and the caulking parts 62*a* at the lower part is fitted each other, as a turning center, so that the lid 140 can be easily attached to the cartridge body 120.

Figure 11:
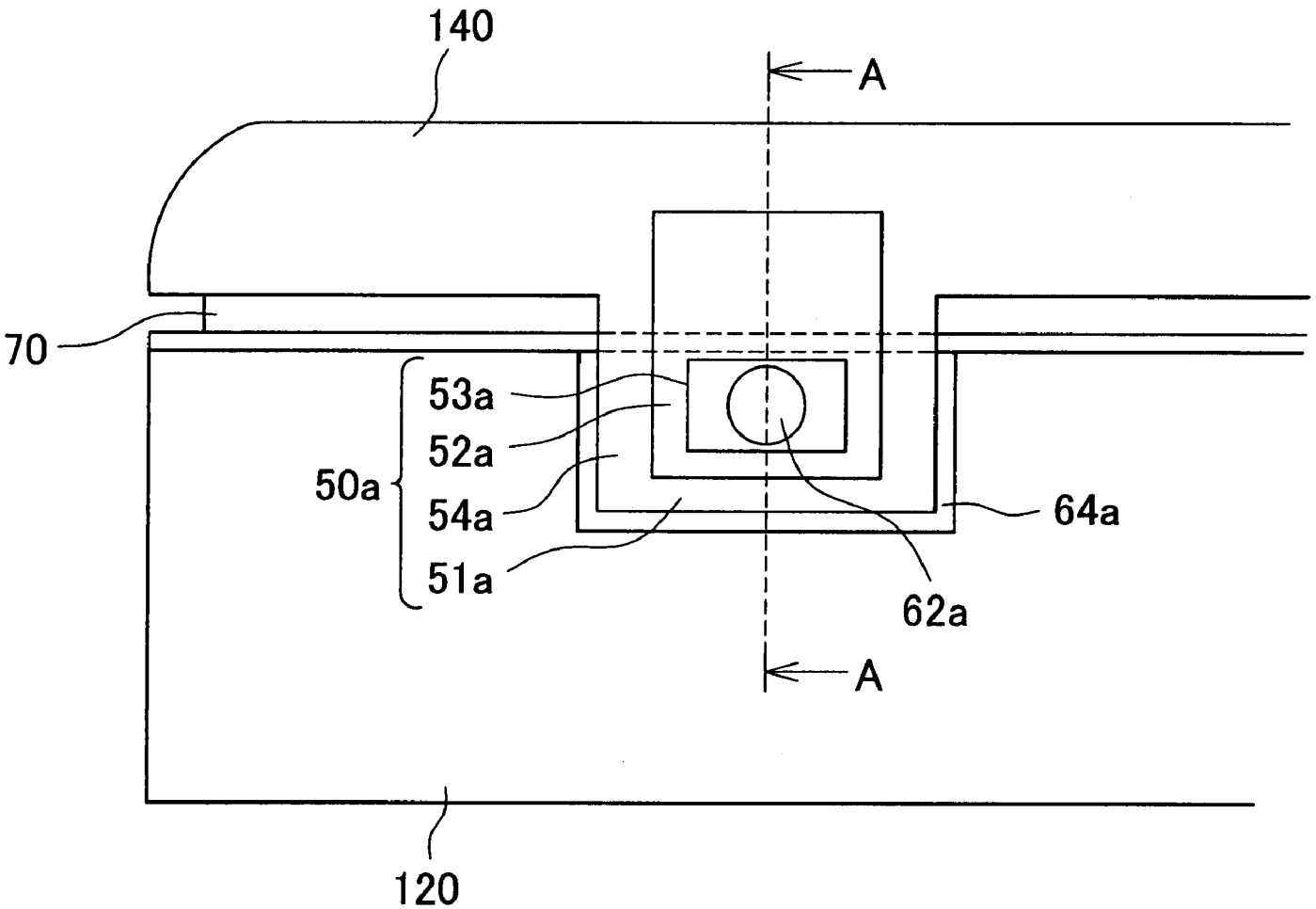
FIG. 11 is a bottom plan view wherein an engaging part 50*a* at a lower face and a caulking part 62*a* are engaged.
Figure 12:
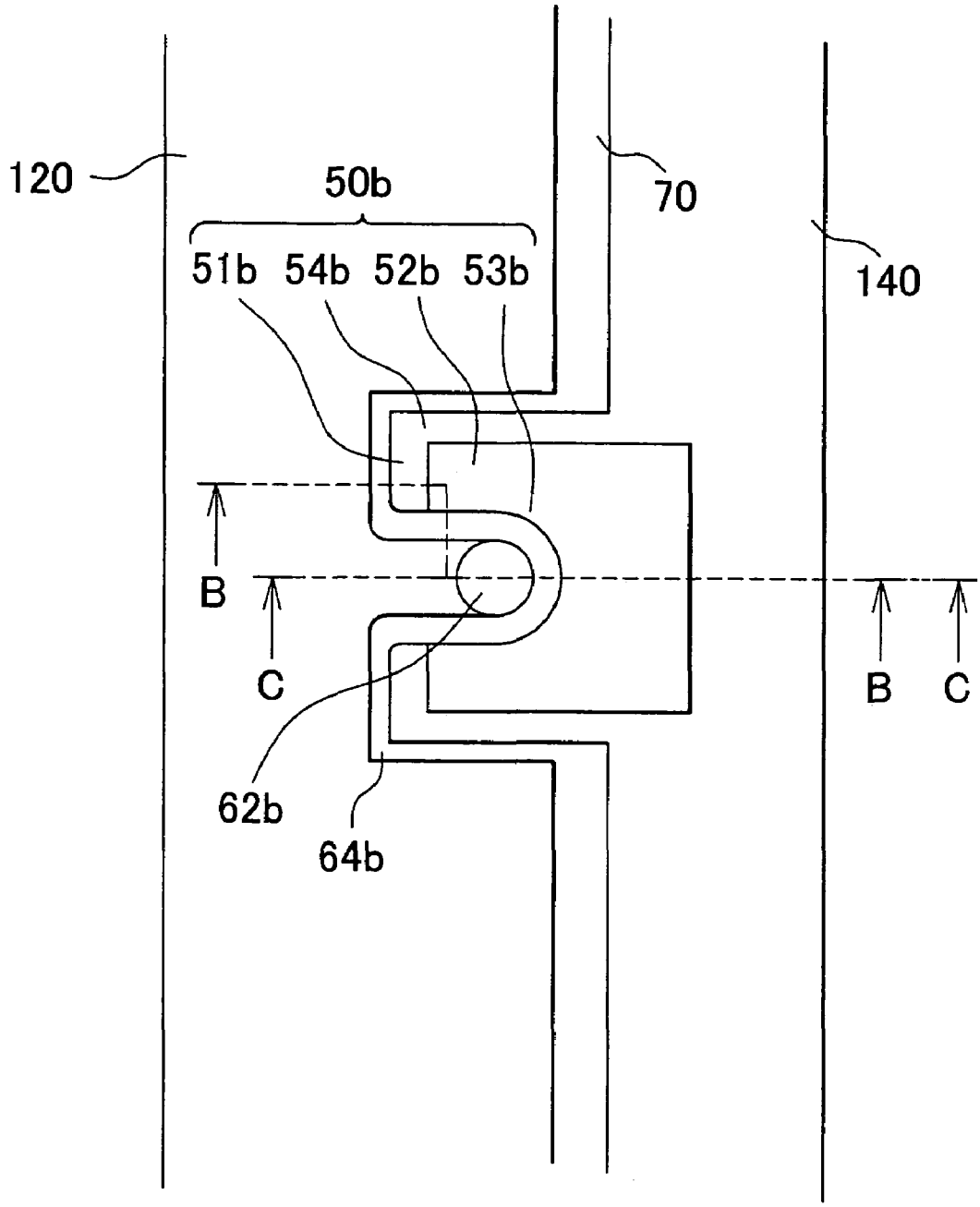
FIG. 12 is a side view wherein an engaging part 50*b* at a left side face and a caulking part 62*b* are engaged.
Figure 13:
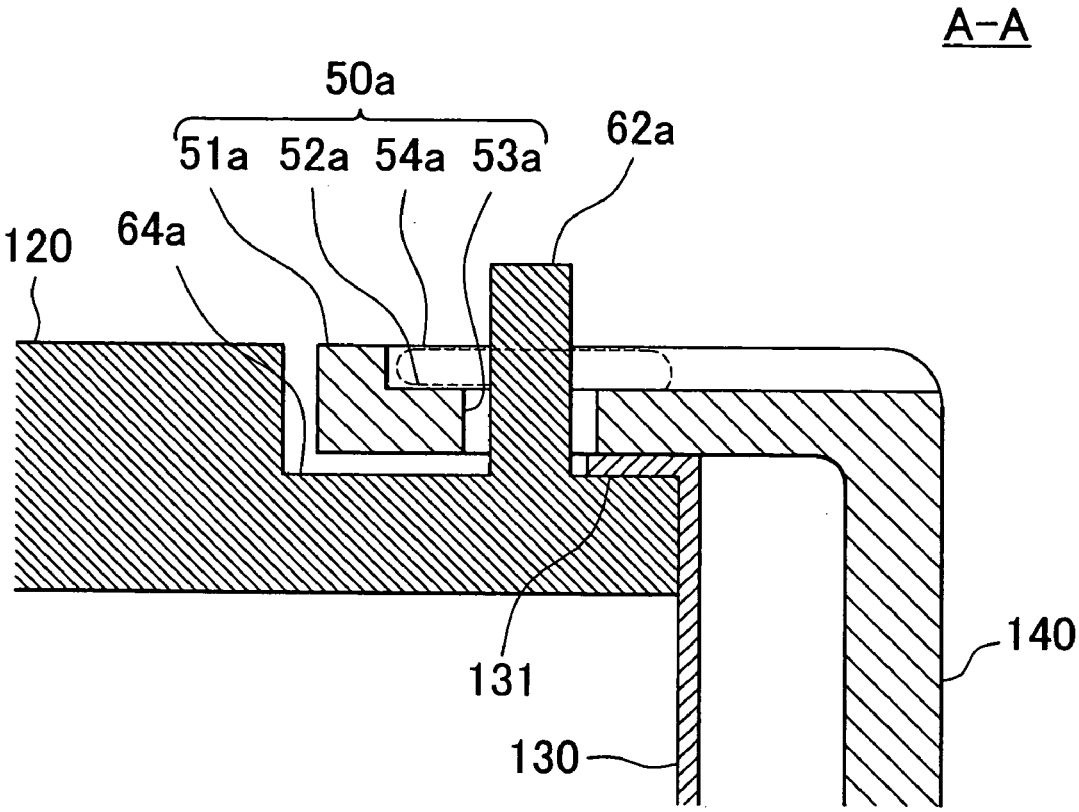
FIG. 13 is a cross-sectional view A—A in regard to FIG. 11.
Figure 14:
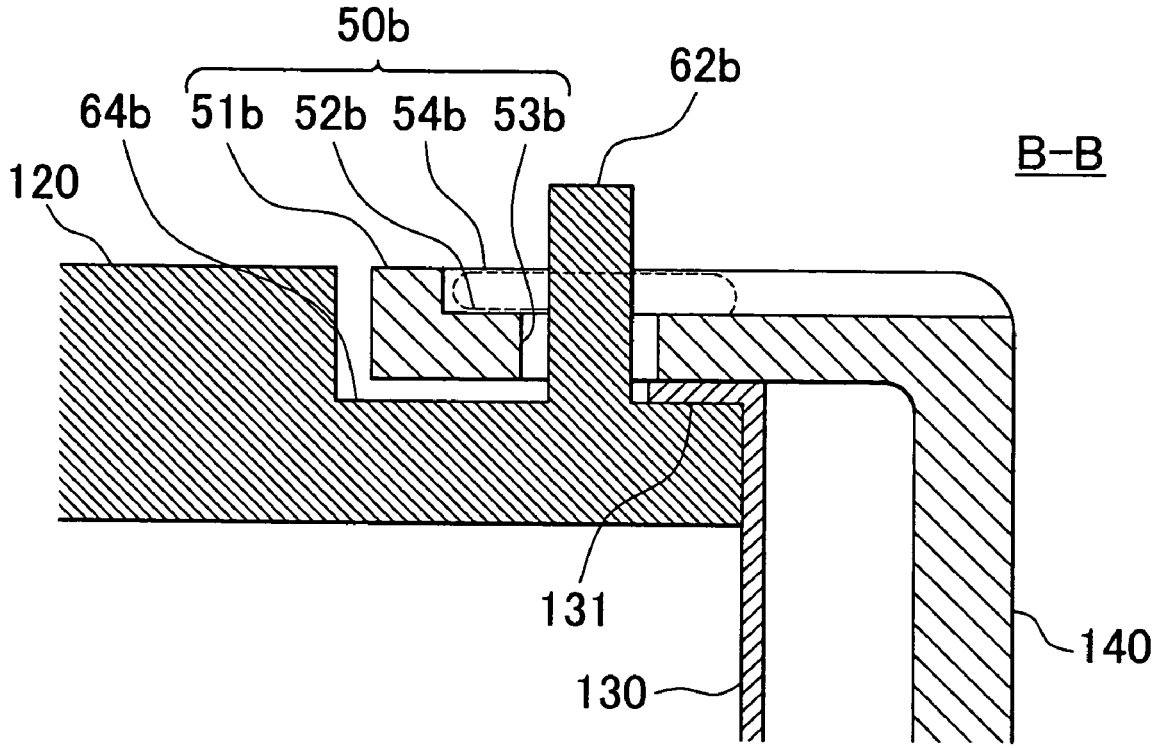
FIG. 14 is a cross-sectional view B—B in regard to FIG. 12.
Figure 15:
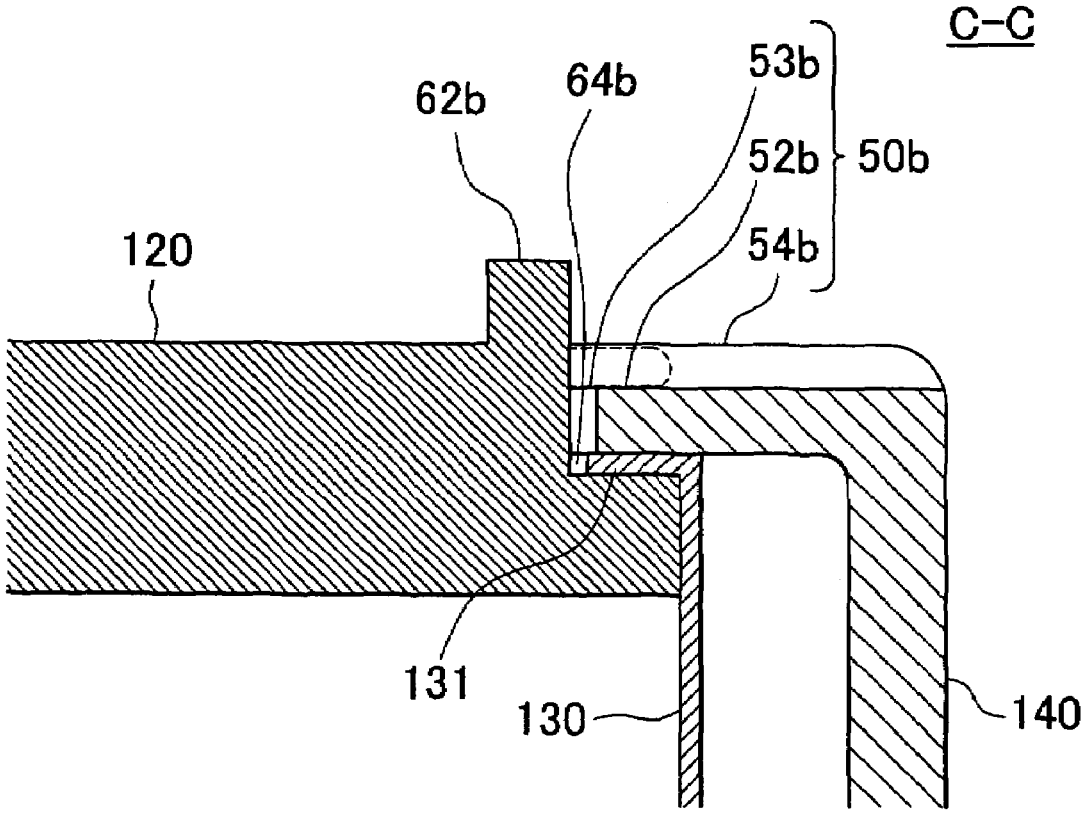
FIG. 15 is a cross-sectional view C—C in regard to FIG. 12.

FIG. 11 is a bottom plan view that shows a state wherein the engaging part 50*a* and the caulking part 62*a* are engaged with each other at the lower face of the ink cartridge 100, and FIG. 12 is a side view a state wherein the engaging part 50*b* and the caulking part 62*b* are engaged with each other at the left side face of the ink cartridge 100. FIG. 13 shows a cross-sectional view A—A in regard to FIG. 11, and FIG. 14 and FIG. 15 are a cross-sectional view B—B and a cross-sectional view C—C in regard to FIG. 12 respectively.

Each of the circumferences of the caulking parts 62*a* and 62*b* is provided with engagement hollows 64*a* and 64*b*, which receive engaging parts 50*a* and 50*b* and have approximately the same widths as those of the engaging parts 50*a* and 50*b* of the lid 140. Therefore, since the engaging parts 50*a* and 50*b* are fitted into the engagement hollows 64*a* and 64*b*, it is possible to suppress rattling between the lid 140 and the cartridge body 120 in a width direction of the engaging parts 50*a* and 50*b*. The lid 140 further has a low position part 70, which is lower than the appearance face of the cartridge body 120, in regard to a fitted part to the cartridge body 120. Due to the low position part 70, it is possible to avoid a difference in level or a gap of the fitted part, which occurs by a measurement difference of or an assembling error between the lid 140 and the cartridge body 120. The low position part 70 may be provided at the cartridge body 120.

The film 130, which is attached to cover the opening part of the cartridge body 120, has a film extending part 131, which extends along a space between the cartridge body 120 and the engaging parts 50*a* and 50*b*. The film extending part 131 is an example of the sealing member extending part of the present invention. The film extending part 131 extends to an area, which faces an edge part of the cartridge body 120 and an edge part of the lid 140. The film extending part 131 is fixed by being held between the edge part of the cartridge body 120 and the edge part of the lid 140, which face each other, and between the engagement hollow parts 64*a* and 64*b* and the extending parts 52*a* and 52*b*. Due to this, it is possible to more securely fix the film 130 to the cartridge body 120.

The depths of the engagement hollow parts 64*a* and 64*b*, which receive the extending parts 52*a* and 52*b*, is approximately the same as those of the end parts 51*a* and 51*b*. Therefore, although the lid 140 is assembled with the cartridge body 120, the end parts 51*a* and 51*b* does not protrude from the side face of the cartridge body 120, and the satisfactory appearance can be achieved.

When caulking the caulking parts 62*a* and 62*b* with, for example, a trowel for thermal caulking in a state the lid 140 is attached to the cartridge body 120, as shown broken lines from FIG. 13 to FIG. 15, the caulking parts 62*a* and 62*b* are melt and broadened over the extending parts 52*a* and 52*b* surrounded by the end parts 51*a* and 51*b* and the side wall parts 54*a* and 54*b*. Due to this, the caulking parts 62*a* and 62*b* cover the surfaces of the extending parts 52*a* and 52*b* beyond the penetrating parts 52*a* and 52*b*. The caulking parts 62*a* and 62*b* covering the extending parts 52*a* and 52*b* fix the extending parts 52*a* and 52*b* in the caulking direction.

Since the engaging parts 50*a* and 50*b* have the end parts 51*a* and 51*b*, which are higher than the extending parts 52*a* and 52*b*, it is possible to get rid of rattling in a direction to which the lid 140 and the cartridge body 120 are separated, as the caulking parts 62*a* and 62*b* are deformed and approach the end parts 51*a* and 51*b* when they are caulked. And, since the engaging parts 50*a* and 50*b* have the side wall parts 54*a* and 54*b*, of which the heights are the same as those of the end parts 51*a* and 51*b*, along the both side ends of the extending parts 52*a* and 52*b*, it is possible to get rid of rattling between the lid 140 and the cartridge body 120 in a direction from the caulking parts 62*a* and 62*b* to the side wall parts 54*a* and 54*b*, as the caulking parts 62*a* and 62*b* are deformed and approach the end parts 51*a* and 51*b* when they are caulked.

The protrusion amount of the caulking parts 62*a* and 62*b* from the penetrating parts 53*a* and 53*b* before caulking is as much as the resin, which results from melting and broadening the caulking parts 62*a* and 62*b* when caulking, can be blocked up by the end parts 51*a* and 51*b* and the side wall parts 54*a* and 54*b*. Accordingly, since the deviation of the ranges and shapes of the melted and broaden resin when the caulking parts 62*a* and 62*b* are caulked over the extending parts 52*a* and 52*b* is suppressed by the end parts 51*a* and 51*b* and the side wall parts 54*a* and 54*b*, it is possible to achieve a good appearance.

In addition, the shapes of the caulking parts 62*a* and 62*b* are not limited to a cylinder like the embodiment of the present invention and may be a square rod. The shapes of the penetrating parts 53*a* and 53*b* are not limited to that of the embodiment of the present invention too and will be fine if they can only allow the caulking parts 62*a* and 62*b* to be inserted.

Figure 16:
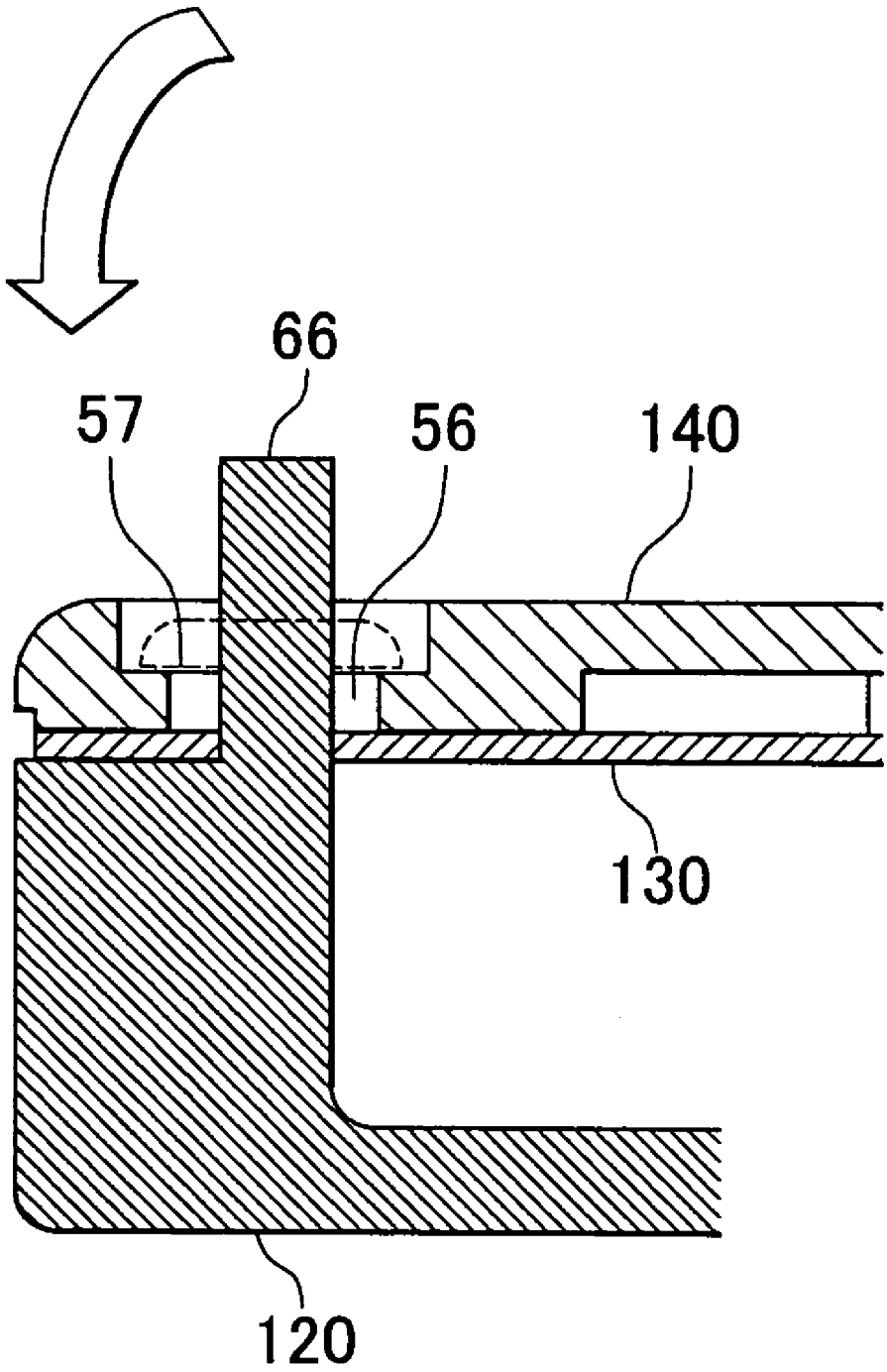
FIG. 16 is a cross-sectional view of a caulking part 56 and a projection 66 at an upper part.

FIG. 16 is a cross-sectional view of the caulking hole 56 and the projection 66 in regard to the upper part of the ink cartridge 100. In assembling the lid 140 to the cartridge body 120, the lid 140 is turned toward the cartridge body 120 taking the fitted part between the engaging parts 50*a* and the caulking parts 62*a* as a turning center, e.g., in the direction of an arrow in the drawing. The projections 66 penetrate the caulking holes 56 of the lid 140, protrude and are caulked over the caulking hollow parts 57 provided around the caulking holes 56, e.g., as a dotted line shown in the drawing. Since the projections 66 are caulked in a direction to allow the lid 140 to adhere to the cartridge body 120, the lid 140 and the cartridge body 120 are more securely fixed.

The caulking hollow parts 57 have volumes as much as they can accept the projections 66 caulked and deformed, and thus the projections 66 do not protrude from the lid when caulked. Therefore, it is possible to keep the appearance of the ink cartridge 100 good after caulking.

Moreover, since the film 130 is held and fixed between the lid 140 and the cartridge body 120 right below the projections 66 caulked, it can be prevented from being got out of the cartridge body 120.

In addition, as described above, the lower face of the ink cartridge 100 is provided with the engaging parts 50*a* having shapes to surround the caulking parts 62*a*, the left and right side faces are provided with the engaging parts 50*b* which are cut in and the upper part of the front face is provided with the projections 66 and the caulking holes 56. According to this configuration, it is possible to make the fitting characteristic of the lid 140 to the cartridge body 120 satisfactory, and besides since the protrusion directions of the projections 66 and the protrusion directions of the caulking parts 62*a* a real most vertical, even though an external force is applied to the protrusion directions of the projections 66 and the protrusion directions of the caulking parts 62*a*, the joint condition between the cartridge body 120 and the lid 140 does not easily broken by the external force from the one direction, and the satisfactorily fixed condition can be maintained.

Moreover, in the embodiment described above, we discussed an example that the engaging parts 50*a* and 50*b* and the caulking holes 56 are formed at lid 140 and the caulking parts 62*a* and 62*b* and the projections 66 are formed at the cartridge body 120, however the caulking parts 62*a* and 62*b* and the projections 66 may be formed at lid 140 and the engaging parts 50*a* and 50*b* and the caulking holes 56 may be formed at the cartridge body 120.

Figure 17:
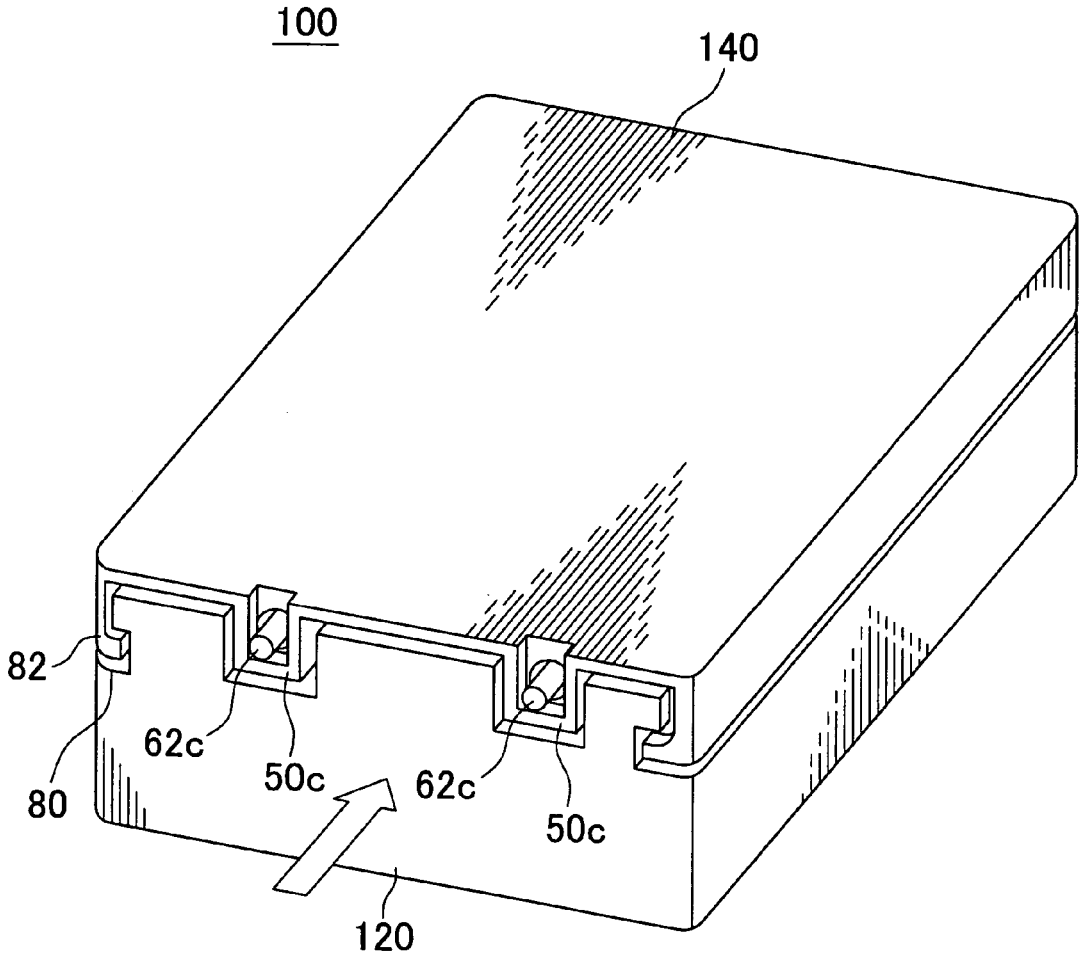
FIG. 17 shows another example of a structure of an ink cartridge 100.

FIG. 17 shows another embodiment of the assembling structure of the ink cartridge 100. In the present embodiment, the ink cartridge 100 further has groove parts 80, which are provided at two side faces, adjacent to the front face of the cartridge body 120 and perpendicular to each other, and extend to be paralleled to the lid 140, and has rail parts 82 which are guided by the groove parts 80. And, engaging parts 50*c* and caulking parts 62*c* are provided on a side face perpendicular to the two side faces at which the groove parts 80 are provided. The caulking parts 62*c* are caulked in the same direction as the rail parts 82 and the groove parts 80 extends. When assembling the lid 140 with the cartridge body 120, the end parts of the rail parts 82 are first fitted into the end parts of the groove parts 80 of the cartridge body 120, and the rail parts 82 slide along the groove parts 80. After the rail parts 82 slide along the groove parts 80, the lid 140 covers the opening part of the cartridge body 120, and the caulking parts 62*c* penetrate the engaging parts 50*c*. At this situation, the caulking parts 62*c* are caulked over the engaging parts 50*c*.

According to this ink cartridge 100, the side face, which is provided with the rail parts 82 and the groove parts 80, does not need to be caulked because the rail parts 82 and the groove parts 80 are fixed by fitting. Therefore, it is possible to easily assemble the lid 140 to the cartridge body 120.

In these embodiments hitherto, the cartridge body 120 and the lid 140 were separate parts. However, the cartridge body 120 and the lid 140 are connected at a first edge to be rotatable in a unified body, so that the ink cartridge 100 may have the engaging parts 50*b* and the caulking parts 62*b* at a second side face including a second edge that faces the first edge connected. When assembling this ink cartridge 100, by turning the lid 140 toward the cartridge body 120 taking the connection part between the cartridge body 120 and the lid 140 as a fulcrum, the engaging parts 50*b* and the caulking parts 62*b* are engaged with each other at the second edge that faces the connection part.

According to this ink cartridge 100, it is possible to cast the lid 140 and the cartridge body 120 in a unified body. Owing to this, there is no measurement mismatch by a combination of the cartridge body 120 and the lid 140, which occurs when casting the cartridge body 120 and the lid 140 separately with a plurality of moulds.

According to the present embodiment, it is possible to prevent the dust or the foreign particles caused by vibration welding from being mixed into the inside of ink cartridge 100 when the lid 140 is attached to the cartridge body 120 of the ink cartridge 100. And, since the end parts 51*a* and 51*b* of the engaging parts 50*a* and 50*b* are engaged with the caulking parts 62*a* and 62*b*, the caulking parts 62*a* and 62*b* are securely fixed.

Although the present invention has been described by way of exemplary embodiments, it should be understood that those skilled in the art might make many changes and substitutions without departing from the spirit and the scope of the present invention which is defined only by the appended claims.

What is claimed is:

1. A liquid cartridge for supplying a liquid by being mounted on a liquid ejecting apparatus, comprising:

a container body having an opening part, which is opened, at a first side face;

a lid, which is attached to said first side face of said container body, for covering said opening part;

a first penetrating part and a second penetrating part, each formed at said lid, each said penetrating part being formed, respectively, at an engaging part, which has an extending part that extends along a second side face adjacent to said first side face of said container body; and a first caulking part and a second caulking part, each formed at said container body and respectively inserted into said first and second penetrating parts in order for a tip part thereof to be caulked, wherein said caulking parts of said container body are respectively located at a plurality of said second side faces adjacent to said first side face, wherein said first penetrating part has a penetrating hole into which said first caulking part is to be inserted, and wherein said second penetrating part has a notch into which said second caulking part is to be inserted.

2. A liquid cartridge as claimed in claim 1, further comprising a sealing member having flexibility for forming a liquid containing chamber, which is a closed space for containing a liquid in association with said container body by sealing said opening part of said container body, wherein said sealing member is covered by said lid at said first side face.

3. A liquid cartridge as claimed in claim 2, wherein said sealing member comprises a sealing member extending part, which extends to an area facing an edge part of said cartridge body and an edge part of said lid, and said sealing member extending part is fixed by being put between said edge part of said cartridge body and said edge part of said lid.

4. A liquid cartridge as claimed in claim 1, wherein at least one said engaging part has an end part a height of which with respect to a direction perpendicular to said second side face is higher than a plane of said extending part.

5. A liquid cartridge as claimed in claim 1 or claim 4, wherein at least one said engaging part further comprising a side wall part provided along both side ends of an associated said extending part, and a height of said side wall part with respect to a direction perpendicular to the second side face is higher than the plane of said associated extending part.

6. A liquid cartridge as claimed in claim 4, further comprising an engagement hollow part, which is provided at said container body or said lid and has substantially the same width as said at least one said engaging part, for accepting that said engaging part, wherein a depth of said engagement hollow part is substantially the same as that of said end part in a direction perpendicular to said second side face.

7. A liquid cartridge as claimed in claim 1, wherein a caulking part, which extends in a direction perpendicular to said first side face, is formed at said container body or said lid, while said penetrating part, into which said caulking part is inserted, is formed at said container body or said lid, which does not have said caulking part.

8. A liquid cartridge as claimed in claim 1, wherein a liquid supplying part is formed at a side face adjacent to said first side face of said container body and communicates with a liquid containing chamber formed at said container body, and said lid is provided with a plurality of engaging parts, which extend along a second side face adjacent to said first side face in order to hold said liquid supplying part, while said container body is provided with a plurality of caulking parts, one of which is inserted into said penetrating part provided at said engaging part.

9. A liquid cartridge as claimed in claim 8, wherein said penetrating part of said engaging part is form d as a penetrating hole at said side face at which said liquid supplying part is formed.

10. A liquid cartridge as claimed in claim 8 or claim 9, wherein said lid comprises an engaging part, which extends along a side face adjacent to said side face, at which said liquid supplying part is formed, and adjacent to said first side face, and said penetrating part of said engaging part is formed as a notch, of which an end part is opened.

11. A liquid cartridge as claimed in claim 8, wherein said container body is provided with said caulking part, which extends in a direction perpendicular to said first side face, near a side face opposite to said side face at which said liquid supplying part is formed, while said lid, which does not have said caulking part, is provided with said penetrating part, which penetrates in a direction perpendicular to said first side face, into which said caulking part is inserted.

12. A liquid cartridge as claimed in claim 1, provided with a memory supporting part for supporting a memory for storing information about a liquid at a second side face adjacent to said first side face of said container body, wherein said memory supporting part is attached to said container body to cover at least one of said caulking parts.

13. A liquid cartridge as claimed in claim 12, wherein said memory supporting part is attached to said container body by caulking a portion of said memory supporting part at a portion of said container body.

14. A method for manufacturing a liquid cartridge, comprising the steps of:

providing the liquid cartridge, the liquid cartridge having;

a container body having an opening part, which is opened, at a first side face;

a lid, which is attached to said first side face of said container body, for covering said opening part;

a first penetrating part and a second penetrating part, each formed at said lid;

a first engaging part, and a second engaging part, each having an extending part that extends along a second side face adjacent to said first side face and an associated said penetrating part; and a first caulking part and a second caulking part, each formed at said container body and respectively inserted into said first and second penetrating parts, in order for a tip part of respective said caulking parts to be caulked, wherein the associated engaging part, penetrating part and caulking part are respectively provided at a plurality of said second side faces;

wherein said first penetrating part has a penetrating hole into which said first caulking part is inserted, wherein said second penetrating part has a notch into which said second caulking part is inserted, determining a position of said lid in regard to said first side face of said container body by fitting said engaging part, which has said penetrating hole with said first caulking part, and fitting said second caulking part into said engaging part having said notch by turning said lid toward said container body, taking a fitted part between said penetrating hole and said first caulking part as a turning center; and deforming said tip part of at least one said caulking part with heat to perform caulking.

15. A method for manufacturing a liquid cartridge as claimed in claim 14, wherein said container body is provided with a caulking part, which extends in a direction perpendicular to said first side face, near a side face opposite to said second side face at which said engaging part having said penetrating hole is formed on said lid, while said lid is provided with a penetrating hole, which penetrates in a direction perpendicular to said first side face into which said caulking part is inserted, and said position determining step further comprises:

fitting said penetrating part, which penetrates in a direction perpendicular to said first side face, with said first caulking part, which extends in a direction perpendicular to said first side face, by turning said lid toward said container body, taking a fitted part between said penetrating hole and said first caulking part as a turning center.

* * * * *